US008607560B2

(12) United States Patent
Fiedler

(10) Patent No.: US 8,607,560 B2
(45) Date of Patent: Dec. 17, 2013

(54) METHOD FOR CENTERING RECIPROCATING BODIES AND STRUCTURES MANUFACTURED THEREWITH

(75) Inventor: Andreas Fiedler, Santa Barbara, CA (US)

(73) Assignee: Superconductor Technologies, Inc., Santa Barbara, CA (US)

( * ) Notice: Subject to any disclaimer, the term of this patent is extended or adjusted under 35 U.S.C. 154(b) by 1184 days.

(21) Appl. No.: 12/039,332

(22) Filed: Feb. 28, 2008

(65) Prior Publication Data

US 2009/0217658 A1 Sep. 3, 2009

(51) Int. Cl.
*F01B 29/10* (2006.01)
*B23P 11/00* (2006.01)

(52) U.S. Cl.
USPC ..... 60/517; 29/888.06

(58) Field of Classification Search
USPC ..... 60/517–526; 29/888.06, 281.1, 464, 29/709
See application file for complete search history.

(56) References Cited

U.S. PATENT DOCUMENTS

| | | | | |
|---|---|---|---|---|
| 2,907,304 | A | 10/1959 | Macks | |
| 4,387,568 | A | 6/1983 | Dineen | |
| 4,545,738 | A | 10/1985 | Young | |
| 5,461,859 | A * | 10/1995 | Beale et al. | 60/517 |
| 5,525,845 | A | 6/1996 | Beale et al. | |
| 6,141,971 | A | 11/2000 | Hanes | |
| 6,293,184 | B1 | 9/2001 | Unger | |
| 6,327,862 | B1 | 12/2001 | Hanes | |
| 6,427,450 | B1 | 8/2002 | Hanes | |
| 6,499,304 | B2 | 12/2002 | Chase et al. | |

(Continued)

FOREIGN PATENT DOCUMENTS

| | | | |
|---|---|---|---|
| EP | 1450472 | A1 | 8/2004 |
| WO | WO 2006/069883 | A1 | 11/2005 |
| WO | WO 2008/108752 | A1 | 3/2007 |

OTHER PUBLICATIONS

PCT Search Report PCT/US2007/005356, Hanes, Oct. 26, 2007.

(Continued)

*Primary Examiner* — Hoang Nguyen
(74) *Attorney, Agent, or Firm* — David B. Murphy, Esq.; O'Melveny & Myers LLP

(57) ABSTRACT

Methods for assembling a reciprocating body, such as a piston, within a bore using a design are described. The piston is substantially centered within the bore and then connected at one end through a rotational coupling to a substantially laterally fixed structure connected to the bore such that during normal operation the piston can rotate within the bore along the bore axis of symmetry but can no longer move laterally. Before fixing the rotational coupling, the piston is connected to an external gas source and substantially aligned along the bore axis of symmetry by a gas bearing having one or more gas bearing ports disposed toward the bore. During normal operation, the gas bearing provides a rotational force sufficient to realize a non-frictional bearing between the piston and the bore. The method of assembly is particularly useful in the assembly of Stirling cycle cryocooler comprising a piston, a compressor bore, adapted to contain the piston, a gas inlet to the piston, a plurality of gas bearing ports located within the piston and disposed toward the compressor bore, the gas inlet being in fluid communication with the gas bearing ports, a rotational coupling structure attached to one end of the piston, and a substantially laterally fixed structure affixed to the compressor bore and the rotational coupling structure.

18 Claims, 22 Drawing Sheets

(56) References Cited

U.S. PATENT DOCUMENTS

| | | | | |
|---|---|---|---|---|
| 6,688,113 | B1 | 2/2004 | Kunimoto et al. | |
| 6,694,730 | B2 | 2/2004 | O'Baid et al. | |
| 6,880,335 | B2 | 4/2005 | O'Baid et al. | |
| 6,880,452 | B2 | 4/2005 | Wiseman et al. | |
| 6,945,043 | B2 * | 9/2005 | Okano et al. | 60/517 |
| 7,137,259 | B2 | 11/2006 | O'Baid et al. | |
| 7,168,248 | B2 * | 1/2007 | Sakamoto et al. | 60/517 |
| 7,458,143 | B2 | 12/2008 | Wiseman et al. | |
| 2004/0182077 | A1 * | 9/2004 | O'Baid et al. | 60/520 |
| 2005/0056036 | A1 | 3/2005 | O'Baid et al. | |
| 2006/0123612 | A1 | 6/2006 | Wiseman et al. | |
| 2007/0157801 | A1 | 7/2007 | Hanes | |
| 2008/0112829 | A1 | 5/2008 | Hell et al. | |

OTHER PUBLICATIONS

PCT Written Opinion PCT/US2007/005356, Hanes, Oct. 26, 2007.
Powell, Design of Aerostatic Gas Bearings, The Machining Publishing Co. Ltd., Chap. 1: Selection of Bearing Type, pp. 15-31, Chapter 2: Theory of Aerostatic Lubrication, pp. 36-66, Chapter 3: Design of Journal Bearings, pp. 68-96, 1970.
PCT Search Report PCT/US2008/073192, Superconductor Technologies, Nov. 5, 2008.

* cited by examiner

METHOD FOR CENTERING RECIPROCATING BODIES AND STRUCTURES MANUFACTURED THEREWITH

RELATED APPLICATIONS

This application claims the benefit of provisional application 60/956,434, filed Aug. 17, 2007, entitled "Method for Centering Reciprocating Bodies and Structures Manufactured Therewith," which is hereby expressly incorporated by reference in its entirety.

FIELD OF THE INVENTION

These inventions relate to methods for centering reciprocating bodies within a bore, and structures manufactured using those techniques. More particularly, the methods and devices are particularly applicable for the assembly and design of cryocoolers and motors, most particularly Stirling cycle cryocoolers and motors.

BACKGROUND OF THE INVENTION

Various entities build Stirling coolers equipped with a fluid bearing linked to compliant structures, such as alternator rods. This design is used for centering the reciprocating compressor piston inside the compressor bore during normal operation.

U.S. Pat. No. 5,525,845 describes a "compliant" linkage for mechanical transducers having a fluid bearing-supported, reciprocating body in a chamber. This reciprocating body can be a compressor piston used for a linear Stirling cooler. The compliant linkage allows the piston to conduct the required lateral movements for proper piston-to-compressor bore alignment. FIGS. 1A-B show the alignment process generated by the gas bearing.

The piston is typically connected to a leaf spring. The axial spring stiffness of a leaf spring is relatively low and the radial stiffness is typically high. The leaf spring also allows the piston axis to be rotated and aligned with little required torque for an axis-parallel orientation relative to the symmetry axis of the compressor bore. However, the rotation of the piston axis alone is not sufficient for proper piston-to-compressor bore alignment. A second, lateral movement of the piston axis is necessary to accomplish the alignment as shown on the right side of FIG. 1A. This design was to connect the leaf spring with a compliant structure or linkage, which works like a lateral spring with a relatively low spring stiffness, thus high lateral compliance " . . . sufficient for the centering forces exerted by the fluid bearing to at least equal the sum of all other lateral forces exerted on the body" (the piston) "including the lateral force exerted upon the body by the linkage, during normal operation of the transducer", e.g. the compressor portion of a Stirling cooler.

The compliant structure can be realized, for example, by using laterally flexible and axially stiff "Alternator Rods." This configuration is schematically shown in FIG. 1A, which also gives an alternative option for a compliant structure. A modified leaf spring, schematically shown in FIG. 1B, can also function as a laterally compliant component.

There are a number of disadvantages to the prior designs described herein. The assembly of the piston and other related components require several operator dependent manufacturing processes, which are critical to ensure cooler performance and long lifetime. Many cooler production problems are related to improper piston and displacer alignment.

U.S. Pat. No. 5,525,845 points out the gas bearing has to be at least equal to the sum of all other lateral forces.

This means that the piston has to be properly pre-aligned during the assembly process for proper functionality as a non-friction bearing. Deformed or misaligned alternator rods can cause additional lateral forces, larger than the provided gas bearing forces, which are limited by the maximum available gas bearing pressure.

Piston alignment problems or additional piston side forces can be even more critical, for example in the case where a Stirling cooler is running at minimum input power condition and the gas bearing stiffness reaches a minimum as well. The gas bearing stiffness is a function of the generated input power-dependent pressure wave inside the compression space of the cooler.

The quality of the pre-alignment process is also determined by the quality and thus the tolerances of the piece parts. Particularly tight tolerances—a few thousands of an inch to a few ten-thousandths of an inch—have to be maintained to minimize the introduced piston side forces during manufacturing.

The assembly process in production has to be conducted with care, preferably by trained operators. Tools are helpful. However, alignment process quality is still operator-dependent.

Alternative methods use complex and expensive methods for aligning the gas bearing. For example, U.S. Pat. No. 7,043,835 provides a computer system for sensing the location of a body within a bore and using microactuators to adjust the position of the body to center it within the bore.

The following references are cited as being of potential background interest: U.S. Pat. No. 5,525,845, issued Jun. 11, 1996, entitled: Fluid Bearing With Compliant Linkage For centering Reciprocating Bodies, (Beale et al.), U.S. Pat. No. 2,907,304, issued Oct. 6, 1959, entitled: Fluid Actuated Mechanism, (Macks), U.S. Pat. No. 4,545,738, issued Oct. 8, 1985, entitled: Linear Motor Compressor With Clearance Seals And Gas Bearings, (Young), U.S. Pat. No. 4,387,568, filed Jun. 14, 1983, entitled: Stirling Engine Displacer Gas Bearing, (Dineen), ICC 11 Paper: Performance and Reliability Improvements in a Low-Cost Stirling Cryocooler, (Hanes), U.S. Pat. No. 7,137,259, entitled: Cryocooler Cold-end Assembly Apparatus And Method, (O'Baid et al.). The foregoing references are hereby incorporated by reference as if fully set forth herein.

SUMMARY OF THE INVENTION

A method is provided for assembling a reciprocating body within a chamber, where the body couples through a rotational coupling to a substantially laterally fixed structure to the chamber, the reciprocating body including a gas inlet and one or more gas bearing ports disposed toward the chamber, the gas inlet and gas bearing ports being in fluidic communication. The typical steps include first providing a reciprocating body within the chamber. Second, gas is flowed through the inlet to the gas bearing (1) while the body is not coupled to a substantially laterally fixed structure (2) at a pressure at least sufficient to cause the reciprocating body to position into a non-contact relationship with the sidewalls of the chamber within the chamber. Thereafter, the rotational coupling is affixed to the substantially laterally fixed structure. Finally, gas flow is discontinued.

The method of assembly is particularly useful in the assembly of a novel Stirling cycle cryocooler. Such a Stirling cycle cooler comprises a piston, a compressor bore, adapted to contain the piston, a gas inlet to the piston, a plurality of gas bearing ports located within the piston and disposed toward the compressor bore, the gas inlet being in fluid communication with the gas bearing ports, a rotational coupling structure attached to one end of the piston, and a substantially laterally fixed structure, coupling, directly or indirectly, the compressor bore and the rotational coupling structure. An indirect affixing can be one in which a housing or other structure couples the substantially laterally fixed structure to the compressor bore.

In one aspect of the invention, a mainly contact-free piston bearing is comprised of a substantially laterally fixed flexure bearing supported by a gas bearing. The piston symmetry axis can tilt, or pivot, around a center of rotation located on the symmetry axis of the compressor bore for achieving proper piston alignment. A lateral movement of the piston symmetry axis as provided in the prior art is no longer required.

In one implementation of the methods, activation of the cooler gas bearing system occurs during cooler assembly by pressurizing the gas bearing cavity via a second inlet. This is an automatic, efficient and fast assembly process for aligning the piston in one step. "Tuning" is not necessary. The quality of alignment is not operator dependent. While the structures and methods are particularly useful for Stirling cycle coolers, they may be utilized for other devices having reciprocating bodies within a chamber. For example, a motor having a cylinder within a bore may utilize the structures and methods described herein. In other embodiments, the methods described herein can be used to center or align rotating bodies within a bore or chamber. For example, the methods can be used to align a rotating body within a cylinder where a tight clearance seal is needed between the rotating body and a stationary body, such as turbine or a vacuum pump. Once the rotating body is aligned, a radially substantially laterally fixed bearing can be used to fix and stabilize the rotating body in a lateral direction.

In one optional aspect of the invention, an improved piston assembly and alignment process is achieved by using elevated gas bearing pressures higher than typical cavity pressures during normal cooler operation. Higher pressure means higher centering forces and better alignment.

In yet another aspect, a method is given for connecting the piston and piston spring to a substantially laterally fixed structure without affecting the piston alignment quality (i.e. requiring a minimum of lateral forces).

In another aspect, a second check valve can be used to close the second inlet automatically during normal cooler operation allowing activation of the inlet multiple times with little additional effort if corrective actions or cooler repair is necessary.

Optionally, there is a reduced number of "active" gas bearing ports during normal cooler operation by disconnecting the ports not required. Activation of all gas bearing ports occurs only during the assembly process. This allows a cost-optimized design for the temporarily used gas bearing ports and restrictor elements due to limited reliability requirements.

It is yet a further object to simplify critical alignment processes in production.

It is yet a further object to increase production yield and reduce risk of cooler failure.

It is yet a further object of this invention to reduce cooler production costs.

In cases where a substantially laterally fixed design cannot be realized, it is an object of the invention to provide a simplified design approach for allowing alignment using a compliant design.

DETAILED DESCRIPTION OF THE INVENTION

Figure 1A:
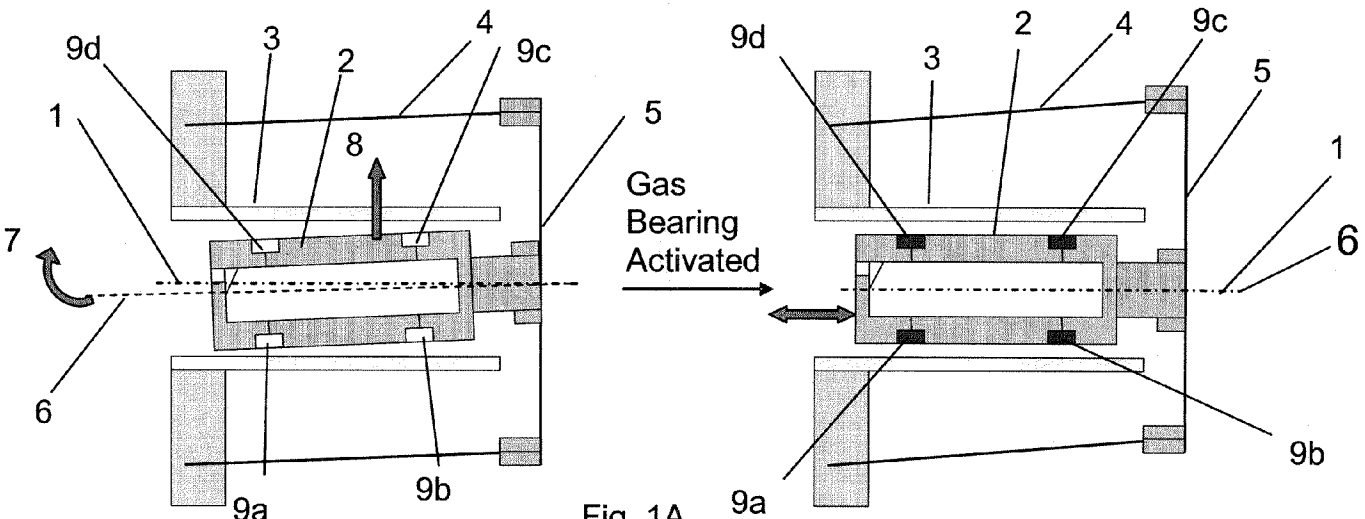
FIG. 1A illustrates a compliant design for a reciprocating body having laterally compliant alternator rods wherein alignment is achieved by activating the gas bearing during normal operation.
Figure 1B:
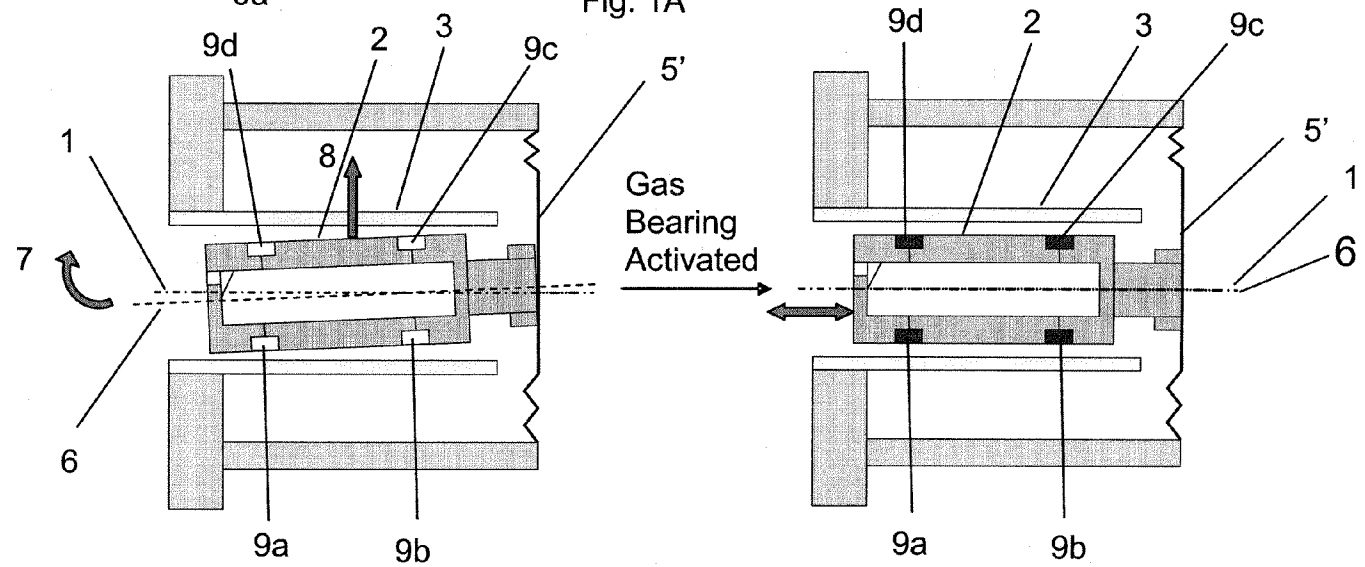
FIG. 1B illustrates an alternative embodiment of a compliant design including a Leaf Spring/Flexure Spring as laterally compliant components.

Turning to the drawings in more detail, FIGS. 1A-B illustrate a method for centering reciprocating bodies, such as a compressor piston for a linear Stirling cooler, equipped with a fluid bearing linked to a compliant structure. In FIG. 1A, piston 2 is configured to reciprocate in compressor bore 3 along the compressor bore symmetry axis 1. The piston 2 is connected to a leaf spring 5 and laterally compliant alternator rods 4 such that when gas bearings 9*a-d* are activated, the piston 2 and its symmetry axis 6 may rotate along the axis of symmetry 1, as shown by arrow 7, and also may move laterally in the direction of arrow 8 in order to become aligned within the compressor bore 3. Alternatively, as shown in FIG. 1B, a modified leaf spring 5' can also be connected to the piston 2 and function as a laterally compliant component to allow for both rotation 7 and lateral movement 8 of the piston 2 to align the piston 2 in the compressor bore 3 and realize a non-friction bearing.

Such designs utilize a "compliant" design. A "compliant" design is one in which a reciprocating body has sufficient lateral compliance, i.e. ability to deflect laterally in response to a force, for the centering forces exerted by the fluid bearing to at least equal the sum of all other lateral forces including the lateral force exerted upon the body by the linkage between the reciprocating body and the bore, thereby allowing the centering forces of the fluid bearing to effectively create a non-friction bearing or a friction optimized bearing such that friction does not reduce the lifetime of the device.

Figure 2A:
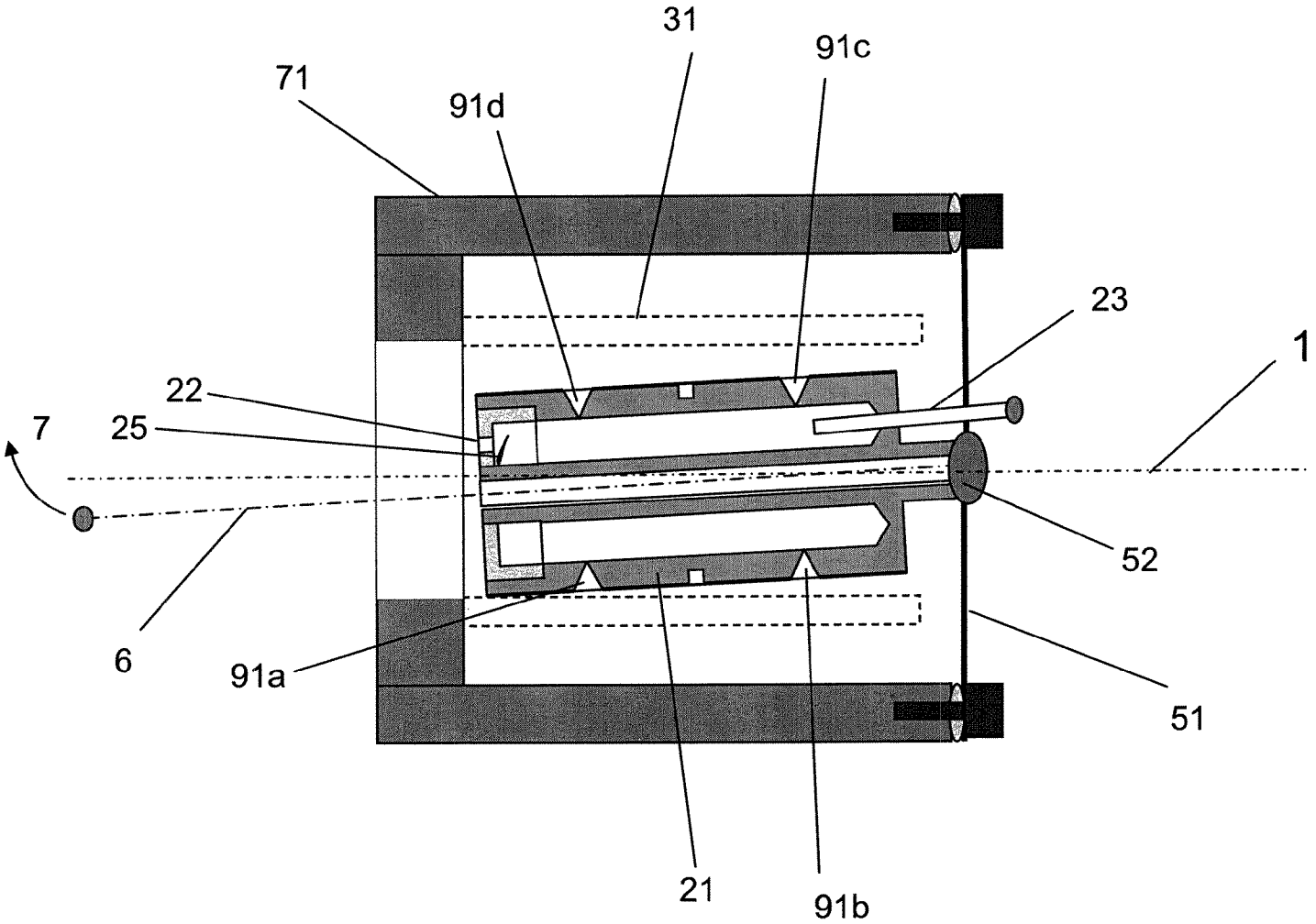
FIG. 2A illustrates an embodiment of a substantially laterally fixed design for a reciprocating body within a chamber.
Figure 2B:
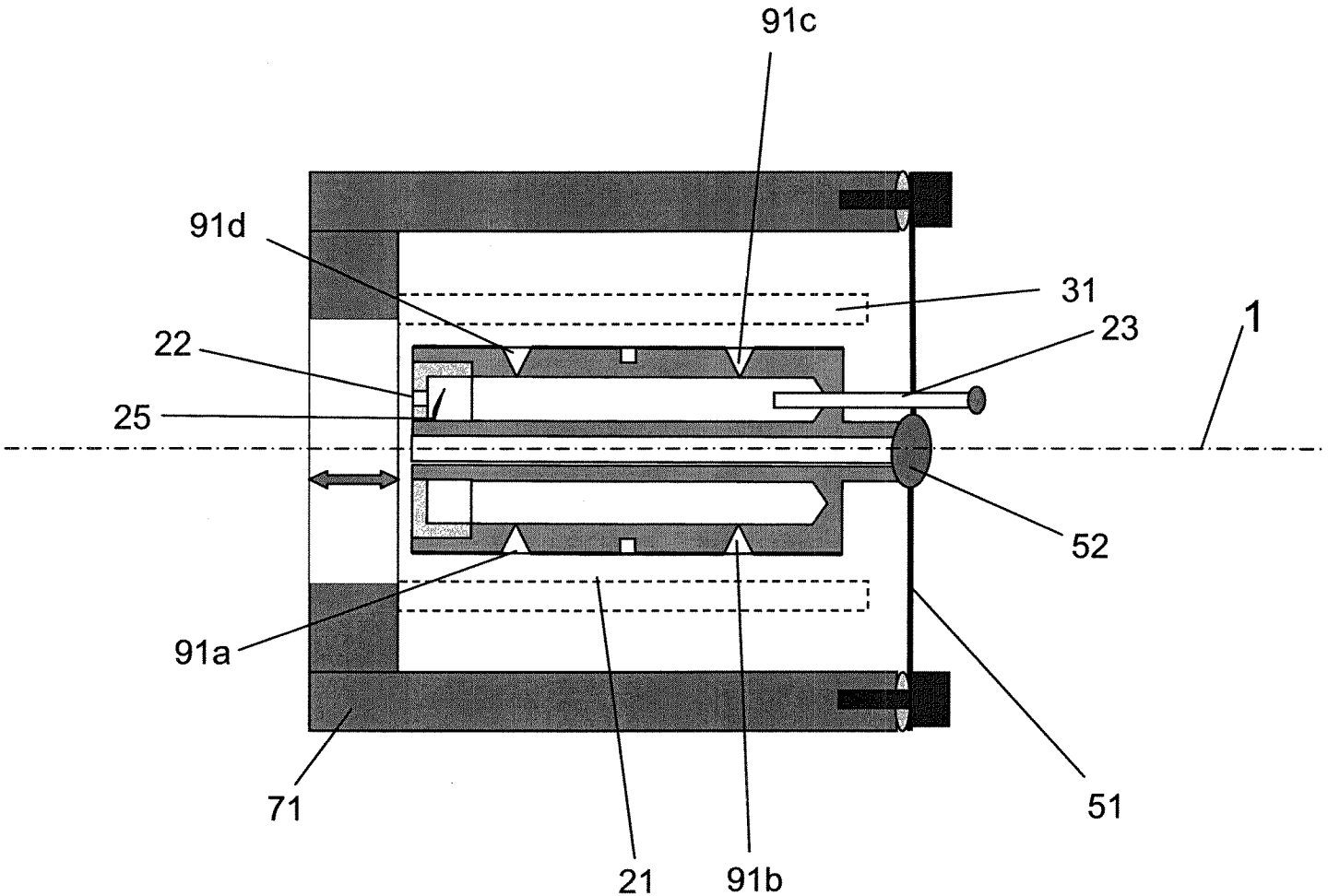
FIG. 2B illustrates the embodiment of 2A wherein the piston has been aligned by activating the gas bearing during normal cooler operation.

As shown in FIGS. 2A-B, the design and the assembly of reciprocating bodies in a bore can be substantially simplified by using a non-compliant design, such as a substantially laterally fixed design. A substantially laterally fixed design can be achieved in the final step of assembly when at least one end of a laterally reciprocating body is substantially radially centered and fixed within a chamber, or bore, by structural, not gas-bearing, forces. The reciprocating body is connected to a substantially laterally fixed structure such that the reciprocating body is only rotating about a center of rotation and no longer moving laterally. While persons skilled in the art will recognize that significant lateral forces could cause a lateral movement, the sum of all lateral forces normally acting on the reciprocating body are insufficient to produce lateral motion causing the reciprocating body contact the chamber walls. Activation of the gas bearing causes the reciprocating body to rotate about the center of rotation for achieving a proper alignment. Thus, during normal operation, a lateral movement of the reciprocating body is no longer required to align the reciprocating body and realize a non-friction bearing.

This method of assembly is particularly useful in the assembly of a novel Stirling cycle cryocooler. While the method of assembly will be described with respect to an embodiment of a Stirling cryocooler, the techniques and structures described herein may be utilized in any device having a reciprocating body within a chamber, such as a Stirling cycle motor having a piston reciprocating within a bore or other reciprocating devices.

As shown in FIG. 2A, one embodiment of a substantially laterally fixed Stirling cycle cooler comprises a piston 21, a compressor bore 31, adapted to contain the piston 21, a gas inlet 22 to the piston 21, a plurality of gas bearing ports 91*a-d* located within the piston 21 and disposed toward the compressor bore 31, the gas inlet 22 being in fluid communication with the gas bearing ports 91*a-d*, a rotational coupling structure 51 attached to one end of the piston 21, and a substantially laterally fixed structure 71, coupling the compressor bore 31 and the rotational coupling structure 51. In the illustrated cross-section, four gas bearing ports 91*a-d* are shown, however, it should be understood that the illustrated embodiment comprises an additional four gas ports 91*e-h* (not shown) symmetrically positioned relative to the illustrated gas bearing ports around the circumference of the piston. In addition, in other embodiments, more or less gas bearing ports can be placed about longitudinally and axially along the piston.

As shown in FIG. 2A, the piston 21 is suspended in compressor bore 31 by a piston spring 51, such a leaf spring comprising a flexure bearing. Once the piston 21 has been substantially aligned on the axis of symmetry 1 of the compressor bore 31, during the assembly process, piston spring 51 is connected to a substantially laterally fixed structure 71. Thus, one end of piston 21 is fixed at a point 52 on or close to the axis of symmetry of the compressor bore 1 such that the piston axis of symmetry 6 can rotate in the direction 7 about the center of rotation 52, but can no longer move laterally. Fixing one end of piston 21 at point 52 requires piston spring 51 to work like a flexure bearing.

During normal operation of the assembly, as shown in FIG. 2B, one end of the piston 21 is supported by the flexure bearing 51 which is connected to a substantially laterally fixed structure 71 and the other end is lifted by a gas bearing, via gas pumped through gas bearing ports 91*a-d* and 91*e-h* (not shown), for centering the piston 21 within the compressor bore 31 and achieving a substantially non-friction bearing. The gas bearing force causes the piston 21 to rotate in direction 7 (see FIG. 2A) about the center of rotation 52 until the piston 21 is centered on the axis of symmetry 1 of the compressor bore 31. In the illustrated embodiment, eight gas bearing ports 91*a-d* and 91*e-h* (not shown) are provided to create the rotational force needed to align the piston. In other embodiments, the gas bearing can include more or less gas bearing ports as required to create an effective centering force. In addition, as discussed below in more detail, in some embodiments one or more additional gas bearing ports can be selectively activated and deactivated as needed depending upon the pressure needed for the gas bearing to center the reciprocating body. Moreover, it will be appreciated by those skilled in the art that a reference to "center" or to "move to the center" does not require exact physical positioning of the reciprocating body at the center of a structure, such as a bore. Rather, it requires that the reciprocating structures move sufficiently far from one another to avoid frictional contact.

As shown in FIG. 2B, supporting one end of the piston 21 by the flexure bearing 51 connected to substantially laterally fixed structure 71 and lifting the other end with the gas bearing eliminates the negative effects of unpredictable piston side loads caused by the deformation of laterally compliant components as described in the Background of the Invention. The main difficulty comes in locating the center of rotation 52, on or close to the symmetry axis 1 of the compressor bore 31 permanently in order to be able to align the piston properly and achieve a non-friction bearing by activating the gas bearing.

Figure 3:
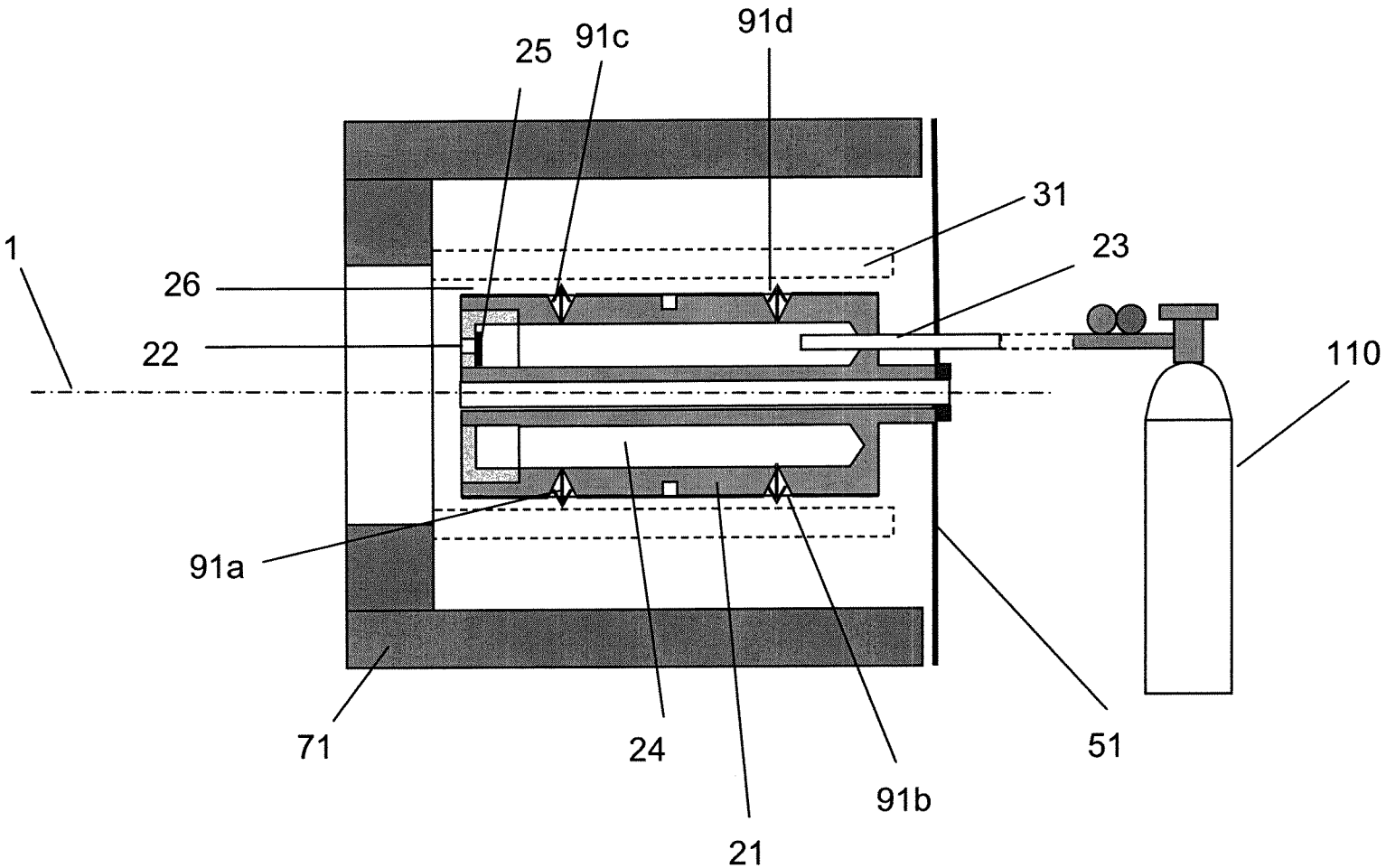
FIG. 3 illustrates a method of aligning the piston to the compressor bore during assembly by using an external gas source to activate the gas bearing.
Figure 4:
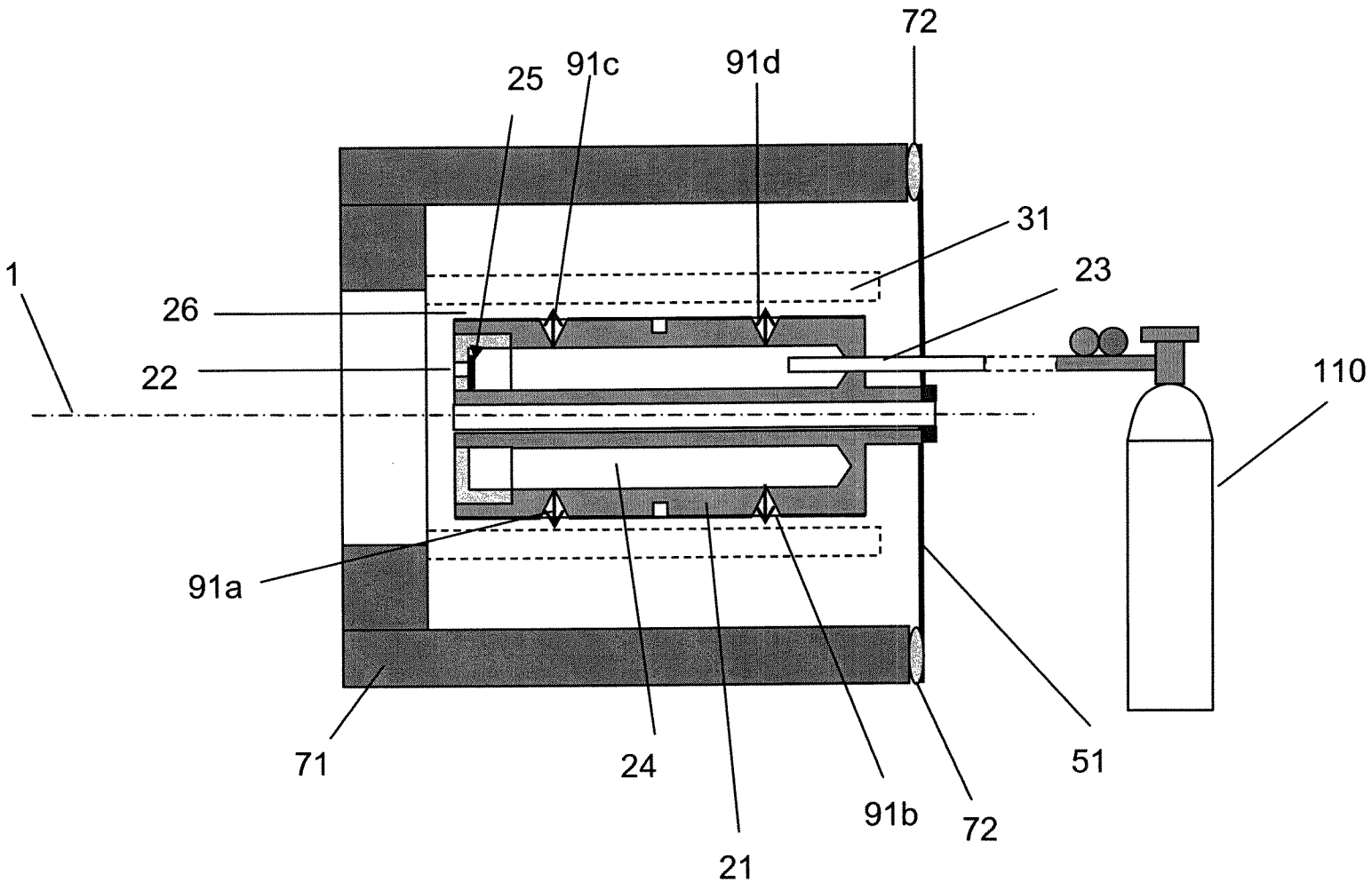
FIG. 4 illustrates a method of temporarily connecting the aligned piston of FIG. 3 to the substantially laterally fixed structure using glue.
Figure 5:
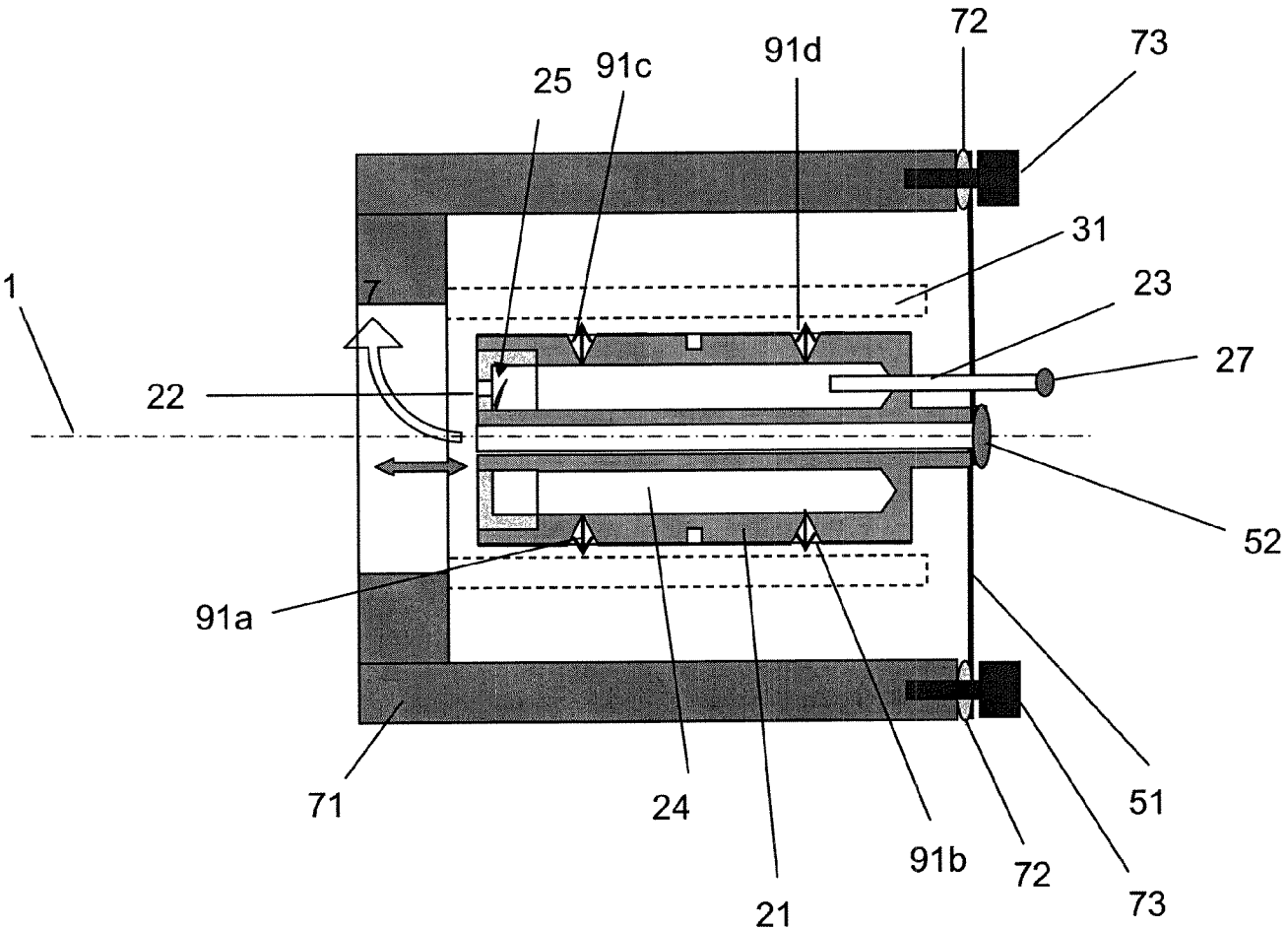
FIG. 5 illustrates a method of permanently connecting the piston spring and substantially laterally fixed of FIG. 4 by using screws.

As shown in FIGS. 3-5, in one embodiment, the piston 21 can be aligned automatically to the compressor bore 31 during the manufacturing and assembly process. For example, during assembly, the piston 21 is suspended in the compressor bore 31 and connected to a piston spring 51, comprising a flexure bearing. A substantially laterally fixed structure 71, such as a cage is fixed to the compressor bore 31. The piston spring 51 has not yet been attached to the substantially laterally fixed structure 71. Thus, the piston 21 can still move both axially and laterally and thus be aligned with respect to the compressor bore 31 and the substantially laterally fixed structure 71. The piston 21 has a first gas inlet 22 and a second gas inlet 23 that provide access to a piston cavity 24. The first and second gas inlets 22 and 23 are both in fluid communication with the gas bearing ports 91*a-d*. The first gas inlet 22 is closed or opened using a check valve 25.

During the assembly and alignment process, the check valve 25 is closed to seal the first gas inlet 22. A gas source 110 is attached to the second gas inlet 23. When the gas source 110 is placed in fluid communication with the second gas inlet 23, the gas will flow through the piston cavity 24 and the gas bearing ports 91*a-d* into the clearance gap 26 between the compressor bore 31 and the piston 21 thus activating the gas bearing. The pressure differences inside the clearance gap 26 caused by the gas flowing from gas bearing ports 91*a-d* will center the piston 21 within the compressor bore 31 for example as described in more detail in Design of Aerostatic Gas Bearings By J. W. Powell B. Sc. (Eng), Ph.D (The Machining Publishing Co., LTD.) incorporated herein in its entirety.

Thus, the piston 21 can be aligned "automatically" to the compressor bore 31 during the manufacturing process without the need for manual adjustments by an operator. No further alignment tools are required. The Stirling cooler structure itself comprises the alignment tool. Moreover, the gas bearing pressure is not limited by the maximum available pressure inside the Stirling cooler during normal operation or by the piston cavity volume. Rather, during assembly, the gas bearing pressure is determined by the pressure of the gas source 110 connected to the piston 21 via the second inlet 23. During the initial assembly and alignment process, the gas source 110 can use elevated gas pressures, higher than the typical cavity pressures, creating a higher gas bearing pressure than possible during normal cooler operation. The higher gas bearing pressure allows increasing the piston centering forces for an improved alignment and more stable manufacturing process.

As shown in FIGS. 4-5, once the piston 21 is aligned along the axis of symmetry 1 of the compressor bore 31, the piston spring 51, preferably a spring with high radial stiffness and low axial stiffness, can be connected to a substantially laterally fixed structure 71, such as a cage to create a rotational coupling between the piston 21 and the compressor bore 31. The rotational coupling created by the connection of the piston spring 51 to the substantially laterally fixed structure 71 has a center of rotation 52 such that the rotational coupling allows the piston to move axially with respect to the compressor bore 31 axis of symmetry 1 but prevents lateral movement of piston 21 with respect to compressor bore 31, thus keeping the piston 21 centered along the axis of symmetry 1 during normal operation after the external pressure source 110 for activating the gas bearing has been removed.

The piston spring 51 can be connected to the substantially laterally fixed structure, for example via either a one step or a two step process. For example, in one embodiment, as shown in FIG. 4, the piston spring 51 is initially bonded to the substantially laterally fixed structure 71 to form an initial connection 72. In some embodiments the bonding can comprise glue, TIG welding, brazing or any other process. Using glue to create an initial connection 72 is advantageous in that the glue removes the need for touching or manipulating the parts during the assembly process. Thus, this method substantially eliminates additional external forces and torques during assembly, which could deflect the components laterally and thus impair the alignment quality. In some embodiments, this initial connection 72 can be the only connection between the piston spring 51 and the substantially laterally fixed structure 71. For example, in some embodiments, the piston spring 51 and the substantially laterally fixed structure 71 can be joined solely by gluing, brazing or welding.

In other embodiments, as shown in FIG. 5, the initial connection 72 is considered a temporary connection and is followed by a second, permanent connection. For example, the piston can initially be temporarily connected by glue 72. Then, once the piston spring 51 has been temporarily connected to the substantially laterally fixed structure 71, the piston spring 51 and the substantially laterally fixed structure 71 can be permanently connected. As shown in FIG. 5, in some embodiments, the piston spring 51 and substantially laterally fixed structure 71 can be permanently connected by one or more screws 73. One end of piston 21 is now fixed at a point 52 on or close to the axis of symmetry of the compressor bore 1 such that the piston can rotate in the direction 7 about the center of rotation 52, but can not move laterally.

After the gas source 110 has been removed, the second gas inlet 23 must be closed off so that the gas bearing can function normally again during operation via the first gas inlet 22. In some embodiments, as shown in FIG. 5, the second gas inlet 23 may be closed with a plug 27. In alternative embodiments, the second gas inlet 23 may be pinched off or closed via a second check valve. The second gas inlet may be closed permanently, or alternatively, the closure for the second gas inlet may be reversible to permit subsequent use of the inlet if needed for corrective alignment or cooler repair at a later time. For example, in some embodiments, a second check valve may be used which closes automatically during normal cooler operation but can be reactivated with little additional effort if the second gas inlet is needed.

As shown and described above, this invention contemplates a method of assembling a reciprocating body within a bore wherein the components are disposed horizontally during assembly. It is further contemplated that in an alternative method, one may advantageously orient the piston and bore vertically during assembly. In a vertical configuration, the gravitational force will not pull the piston toward the bore, thus the centering forces required from the gas bearing can be less and the alignment quality improved.

Figure 6A:
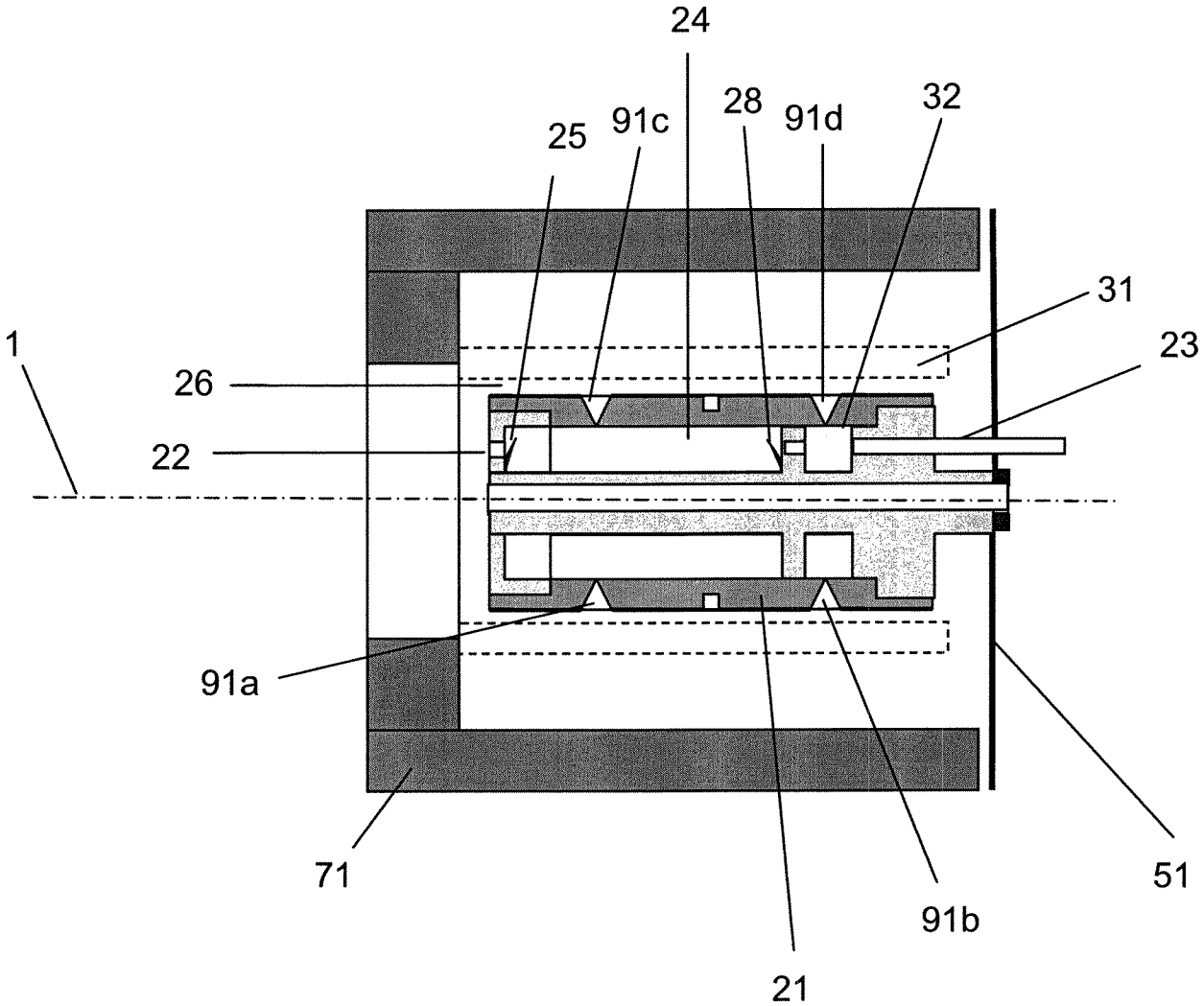
FIG. 6A illustrates an alternative embodiment having two check valves for selectively activating the gas bearing ports.
Figure 6B:
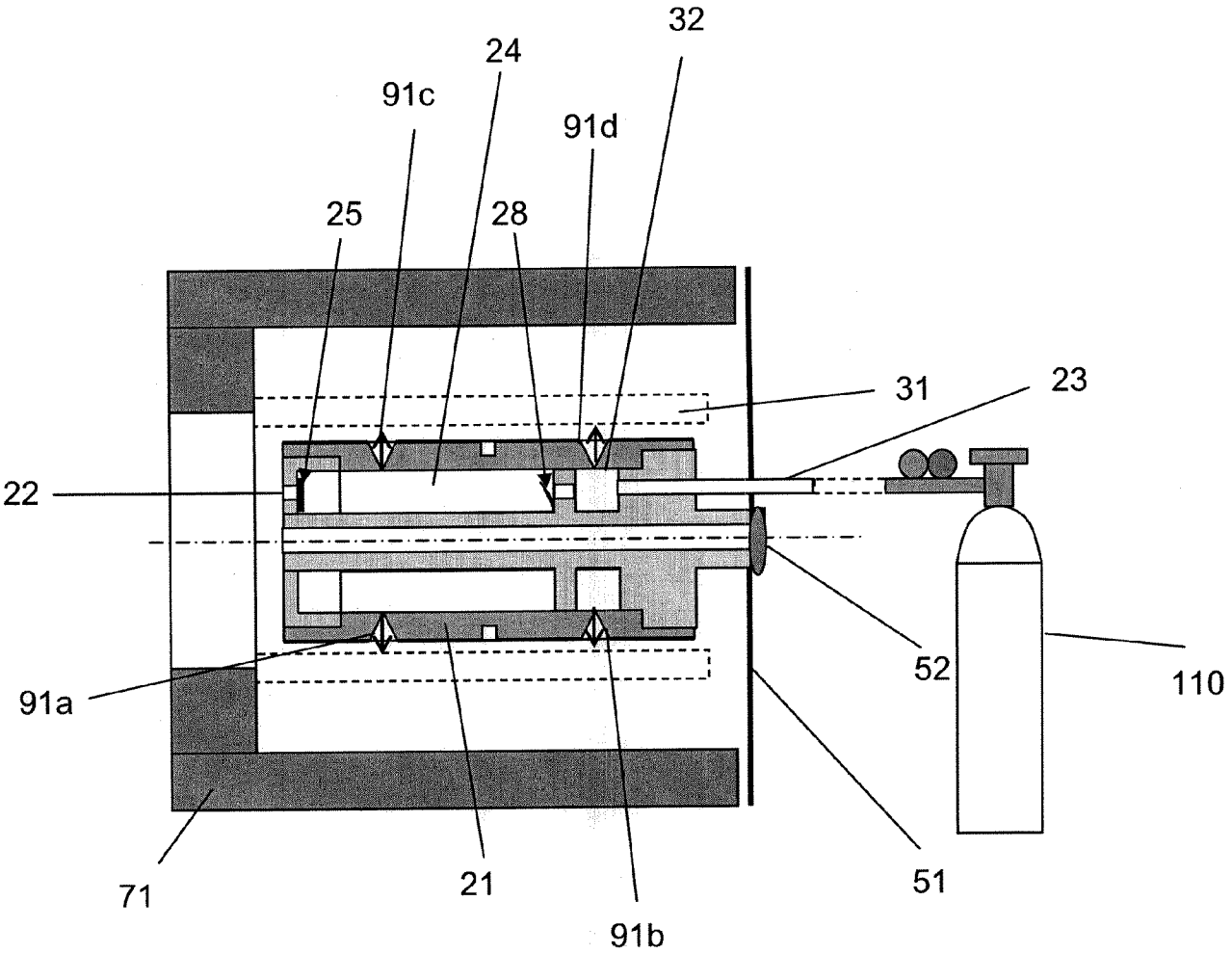
FIG. 6B illustrates the embodiment of FIG. 6A wherein the second check valve is open to permit activation of all the gas bearing ports during the assembly process.
Figure 6C:
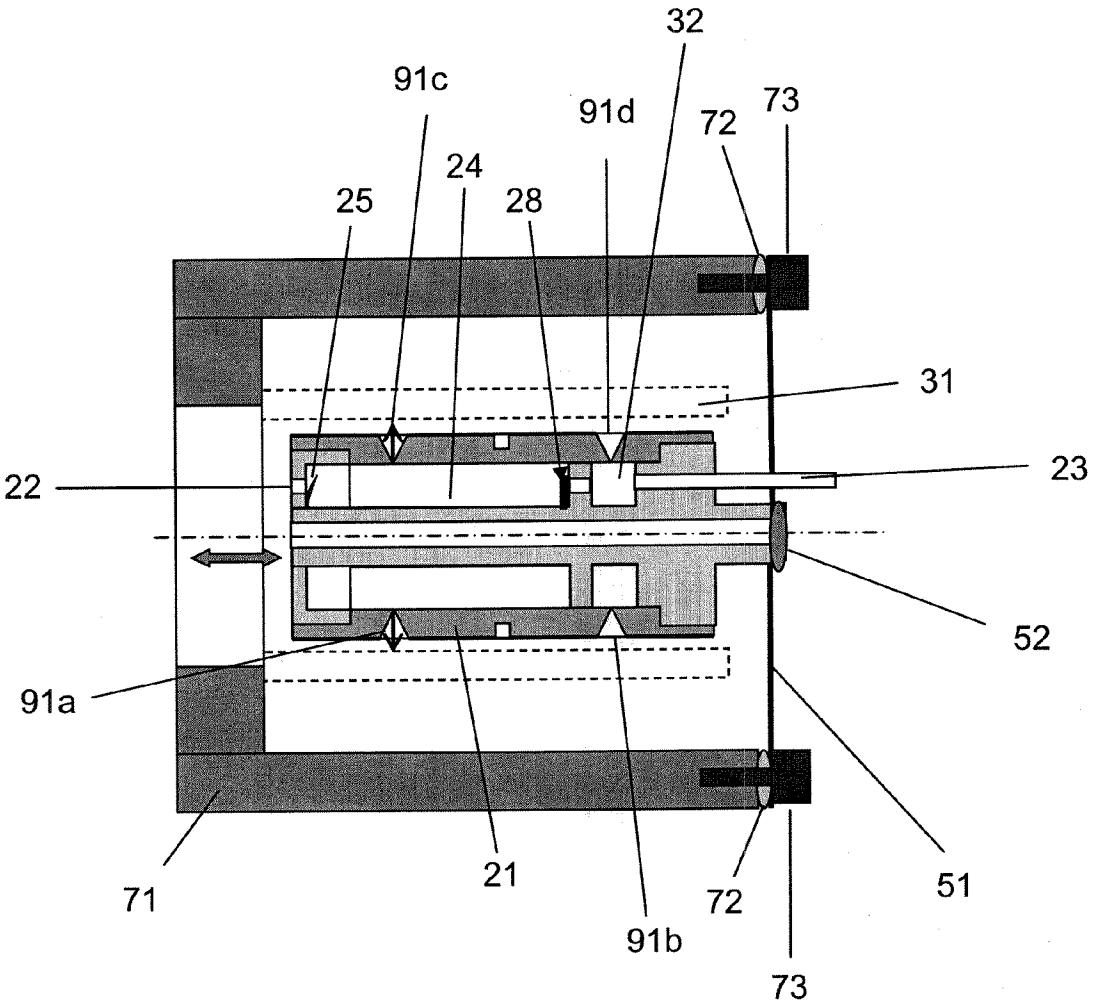
FIG. 6C illustrates the embodiment of FIG. 6B wherein the second check valve is closed to deactivate some of the gas bearing ports during normal operation.

In some embodiments, as shown in FIGS. 6A-C, the piston cavity 24 can include multiple check valves for providing fluidic access to the piston cavity 24 and thereby selectively controlling operation of the gas bearing ports 91*a-d*. As shown in FIG. 6A, in one embodiment, the piston cavity 24 includes a first check valve 25 located at the gas inlet 22 at the end of the piston cavity 24 and a second check valve 28 located in the piston cavity 24 between gas bearing ports 91*b,d* and 91*a,c*.

As shown in FIG. 6B, during the assembly process check valve 25 is closed preventing fluid from flowing out of gas inlet 22. Check valve 28 is opened by the gas pressure difference to allow gas from gas source 110 to flow through the piston cavity 24 and exit gas bearing ports 91*a-d* for centering the piston 21. Once the piston 21 has been permanently connected to the substantially laterally fixed structure at a center of rotation 52, the piston 21 is jointly supported during normal cooler operation by the gas bearing and the flexure bearing created by the piston spring 51 being attached to the substantially laterally fixed structure 71, as shown in FIG. 6C. Since the flexure bearing is now bearing some of the side load, less gas bearing forces are needed to center the piston 21 within the chamber 31. Thus, during normal operation of the assembly, the second check valve 28 is automatically closed due to the pressure difference between piston cavity 24 and volume 32. The second check valve 28 thereby seals off access to gas bearing ports 91*b* and *d* which are no longer needed to provide sufficient centering forces. More limited reliability requirements for the less utilized gas bearing ports 91*b* and *d* allow for simplification and cost reduction of their design. The first check valve 25 is made operational to permit compressed gas to flow into the piston cavity 21 through gas inlet 22 and exit gas bearing ports 91*a* and *c* to activate the gas bearing.

Figure 7A:
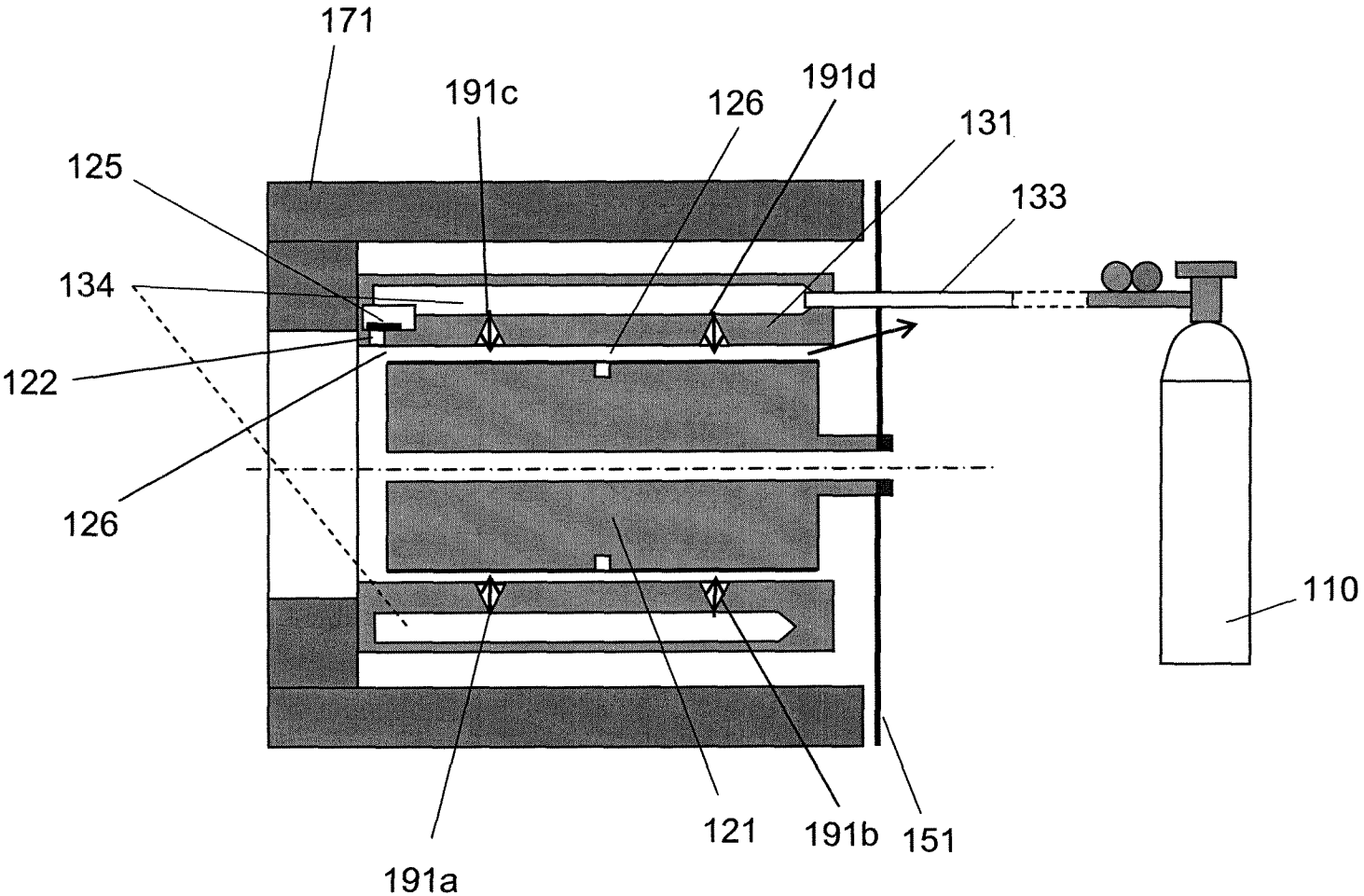
FIG. 7A illustrates an alternative embodiment wherein the gas bearing cavity is located within the static compressor bore.

In an alternative embodiment for a substantially laterally fixed design, the gas bearing for aligning the piston can be integrated into the compressor bore instead of the piston. Here, as shown in FIG. 7A, piston 121 is suspended in the compressor bore 131 by a piston spring 151 such as a leaf spring comprising a flexure bearing. The compressor bore 131 has a first gas inlet 122 and a second gas inlet 133 which provide fluid access to compressor bore cavity 134. The compressor bore cavity 134 is also in fluid communication with gas bearing ports 191*a-d* located on the inner wall of the compressor bore 131 which are configured to release gas from the compressor bore cavity 134 into the clearance seal 126 toward the piston 121. Similar to the above mentioned embodiment, in the illustrated cross-section, four gas bearing ports 191*a-d* are shown, however, it should be understood that the illustrated embodiment comprises an additional four gas ports 191*e-h* (not shown) symmetrically positioned relative to the illustrated gas bearing ports around the inner wall of the compressor bore 131. In addition, in other embodiments, more or less gas bearing ports can be placed along the inner wall of the compressor bore 131.

Figure 7B:
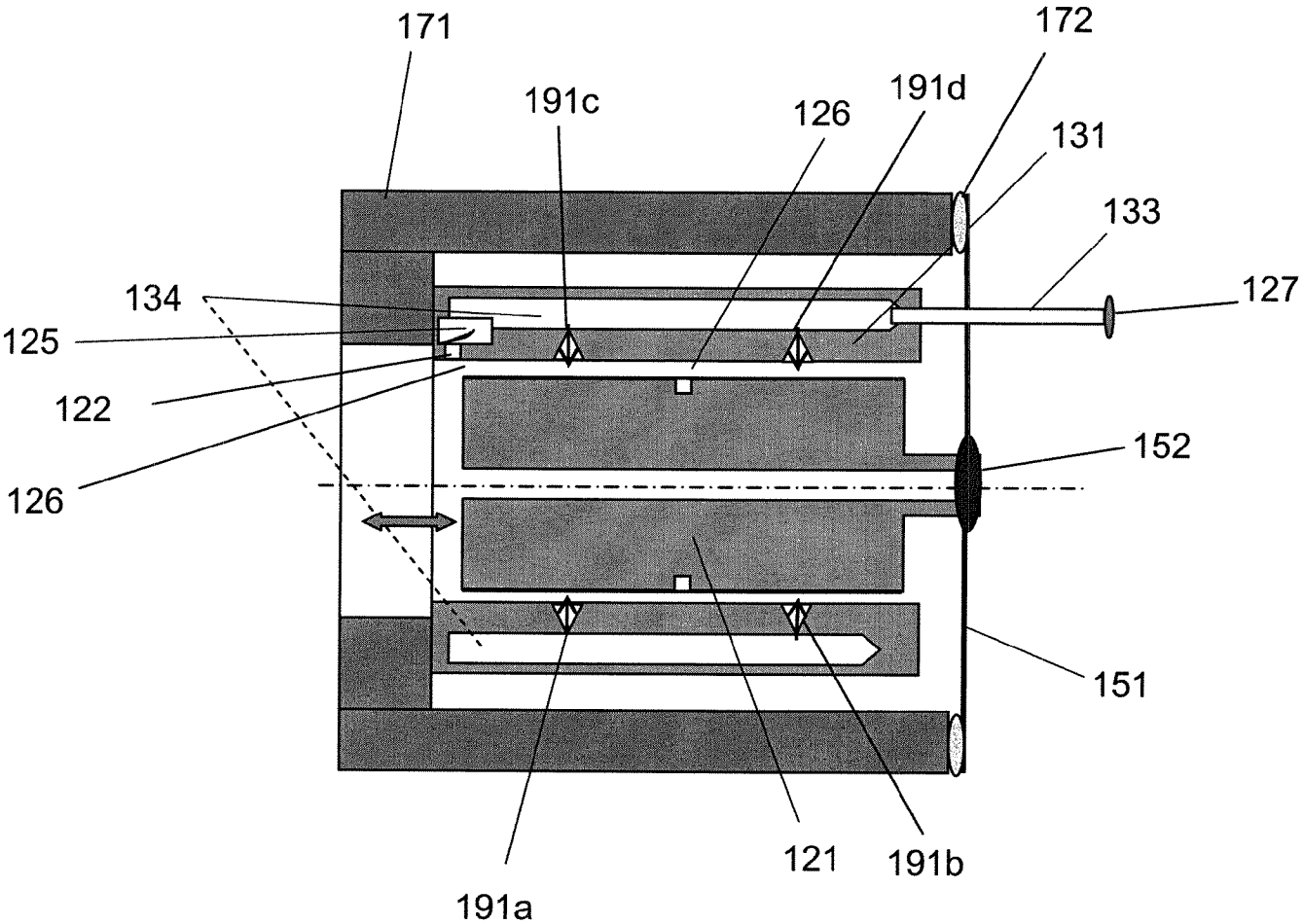
FIG. 7B illustrates the embodiment of FIG. 7A wherein glue is used to bond the piston spring and substantially laterally fixed structure.

As shown in FIG. 7A, during assembly and alignment of the piston 121, a check valve 125 is closed to seal gas inlet 122. A gas source 110 is connected to first gas inlet 133. Gas flowing from the gas source 110 will flow through the compressor bore cavity 134 and exit the gas bearing ports 191*a-d* into clearance gap 126 thus activating the gas bearing. The pressure differences inside the clearance gap 126 caused by the gas flowing from gas bearing ports 191*a-d* will center the piston 121 within the compressor bore 131. As discussed above, once the piston 121 has been centered within the compressor bore 131, the piston spring 151 can be connected to a substantially laterally fixed structure 171, such as a spring cage to create a rotational coupling between the piston 121 and the compressor bore 131. As shown in FIG. 7B, attachment of the piston spring 151 to the substantially laterally fixed structure 171 creates a flexure bearing which allows the piston 121 to rotate about the center of rotation 152 within the compressor bore 131 but prevents the piston 121 from moving laterally within the compressor bore 131.

In some embodiments, as shown in FIG. 7B, the piston can be connected to the substantially laterally fixed structure 171 via an initial connection 172 such as bonding, welding, brazing or gluing. Creating the initial connection without the need for touching or manipulating the parts during the assembly process is advantageous in that it minimizes the external forces and torques on the piston 121 and/or compressor 131 during assembly which could deflect the components laterally and thereby affect the alignment quality. In some embodiments, this initial connection 72 can be the only connection between the piston spring 151 and the substantially laterally fixed structure 171. Alternatively, in some embodiments, the piston spring 151 and the substantially laterally fixed structure 171 can then be connected permanently for example with one or more screws. Once the piston spring 151 has been connected to the substantially laterally fixed structure 171, either via solely the initial connection or alternatively via both the initial and permanent connections, the gas source 110 can be removed. The gas inlet 133 can then be sealed off, for example with plug 127, to allow the gas entering the compressor bore cavity 134 through the gas inlet 122 during normal operation to flow through the gas bearing ports 191*a-d* thus activating the gas bearing to center the piston 121 in the compressor bore 131 and realize a non-friction bearing.

Figure 8:
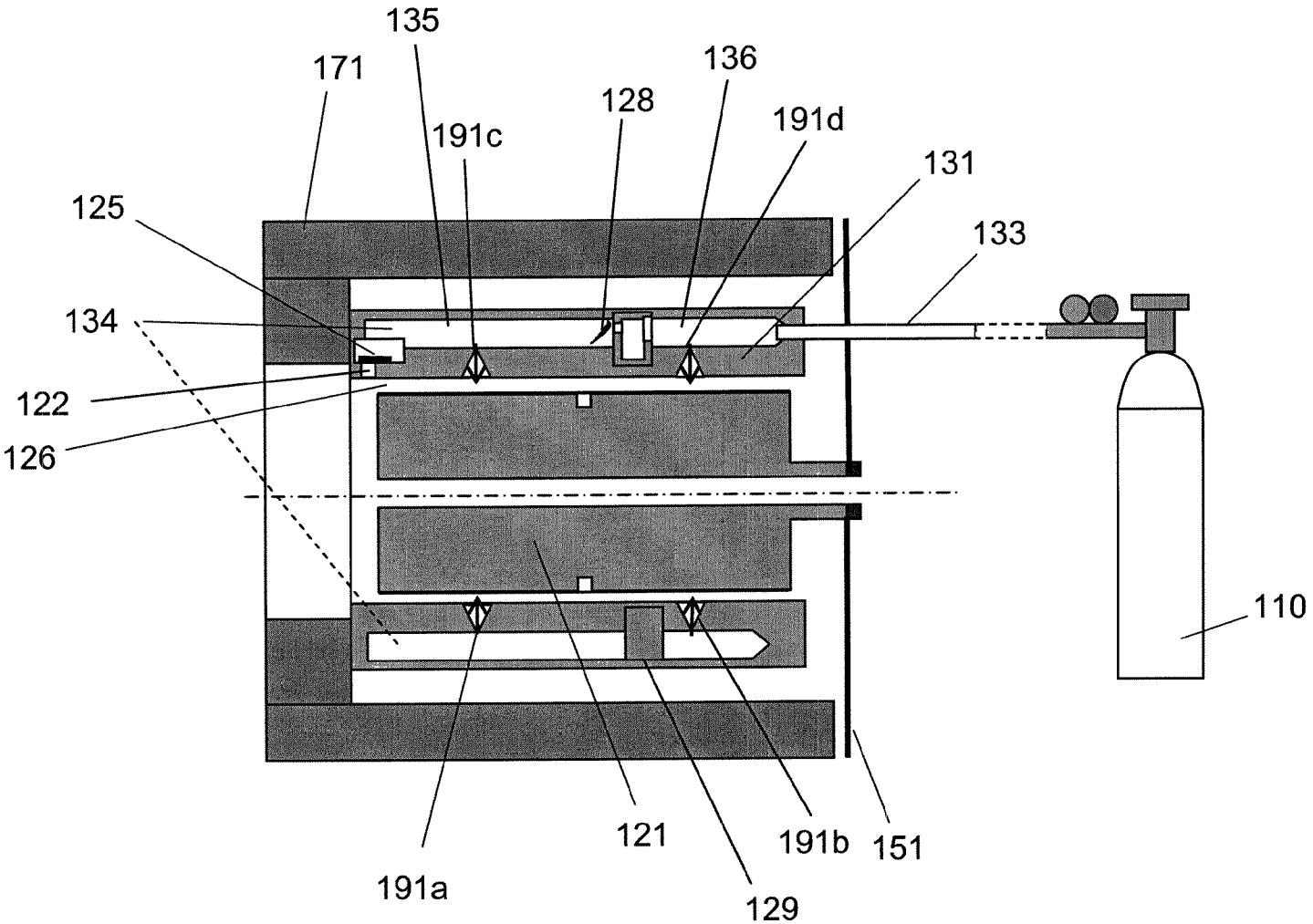
FIG. 8 illustrates an alterative embodiment wherein the gas bearing cavity integrated into the compressor bore has two check valves for selectively activating the gas bearing ports.

In an alternative embodiment, the compressor bore cavity 134 can include multiple check valves for selectively controlling activation of gas bearing ports 191*a-d*. Using multiple check valves allows all the gas bearing ports to be opened during the assembly or a possible repair process. For example, in one embodiment, as shown in FIG. 8, the compressor bore cavity 134 includes first check valve 125 located at gas inlet 122 at the end of the compressor bore cavity 134 and a wall 129 containing a second check valve 128 located between gas bearing ports 191*b,d* and gas bearing ports 191*a, c*. The wall 129 separates compressor bore cavity into a first, active cavity 135 containing gas bearing ports 191*a,c* and gas inlet 122 and a second cavity 136 containing gas bearing ports 191*b,d*. During normal operation of the cooler, check valve 128 is automatically closed by the pressure difference between the active cavity 135 and the inactive cavity 136, thus deactivating gas bearing ports 191*b,d*.

Figure 9:
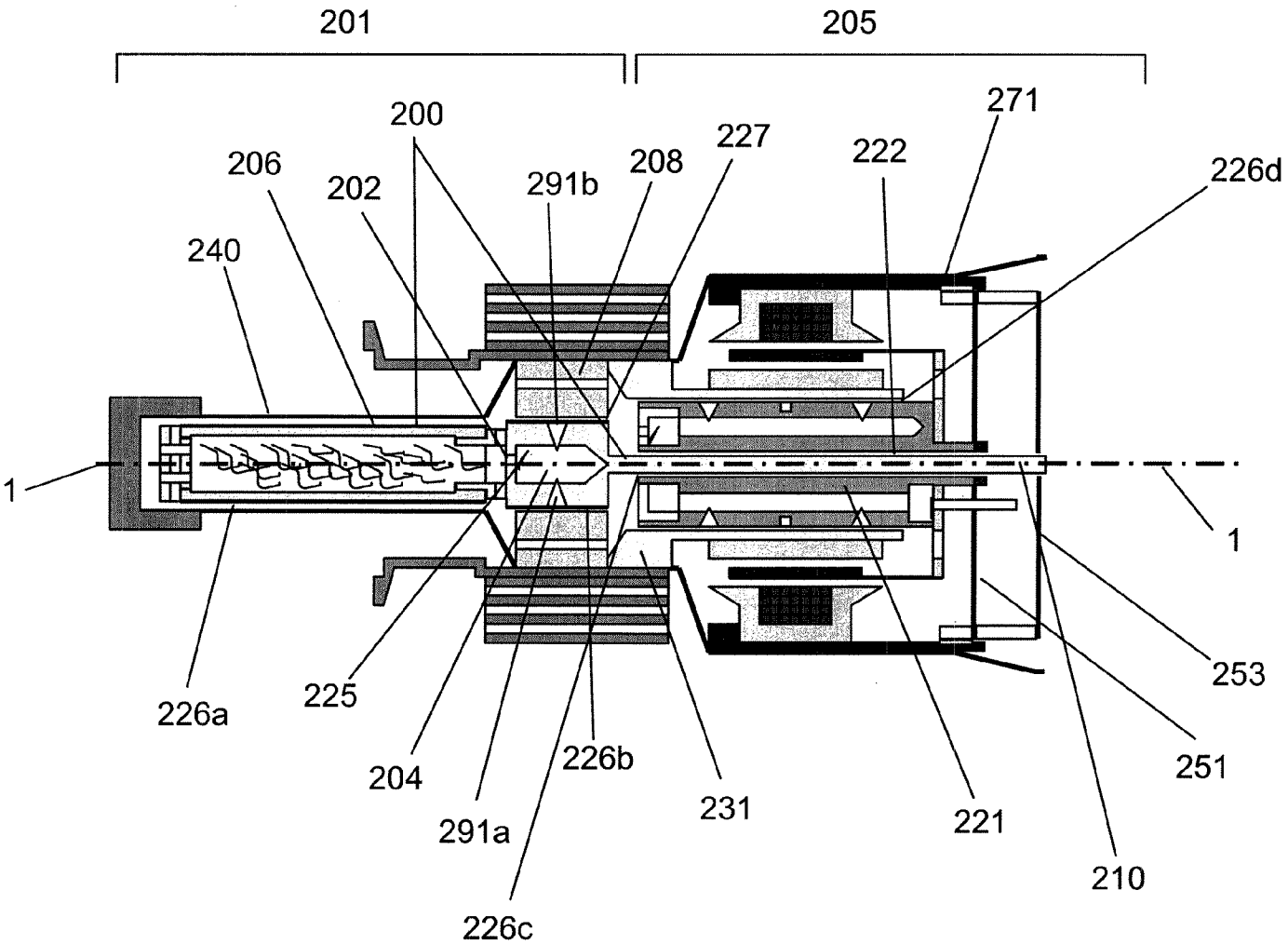
FIG. 9 is a cross-sectional view of a displacer ready to be aligned and assembled.

In an alternative embodiment, as shown in FIGS. 9-14, the structures and methods described above can be used to assemble a displacer within a Stirling cryocooler such as the Stirling cryocoolers described in U.S. Pat. Nos. 6,141,971, 6,327,862, 6,499,304, 6,694,730, and 6,688,113, all incorporated herein by reference as if fully set forth herein. As shown in FIG. 9, the Stirling cryocooler comprises a cold-finger 201 and a compressor section 205. The compressor piston 221 has been aligned within the compressor bore 231 and the piston spring 251 has been attached to the substantially laterally fixed structure 271 as described above in reference to FIGS. 3-5. With reference to FIG. 9, the displacer 200 has not yet been assembled. The displacer 200 comprised of the displacer body 206 and displacer rod 210 has to be positioned coaxially within the inner bore 222 of the compressor piston 221 and the cold finger tube 240 in order to avoid friction between the displacer parts and the adjacent structures. The piston 221 and the displacer 200 are sealed via clearance seals 226*a-d* between the displacer body 206 and the cold finger tube 240, the displacer rod 210 and the heat exchanger 208, the displacer rod 210 and the inner bore 222 of the piston 221 and the piston 221 and compressor bore 231. Thus, the radial gaps between the displacer body 206 and the adjacent cold finger components and between the displacer rod 210 and the inner diameter of the piston 221 are tight, and therefore the radial play between the displacer 200 and the adjacent components, including the compressor bore 231, heat exchanger 208 and the cold finger tube 240 is small as well, for example in some embodiments as small as several ten-thousandths of an inch. Moreover, it is important that the displacer body 206 does not touch the adjacent components such as the cold finger tube 240 during normal operation as this can cause wear and reduce the lifetime of the cooler.

Figure 10A:
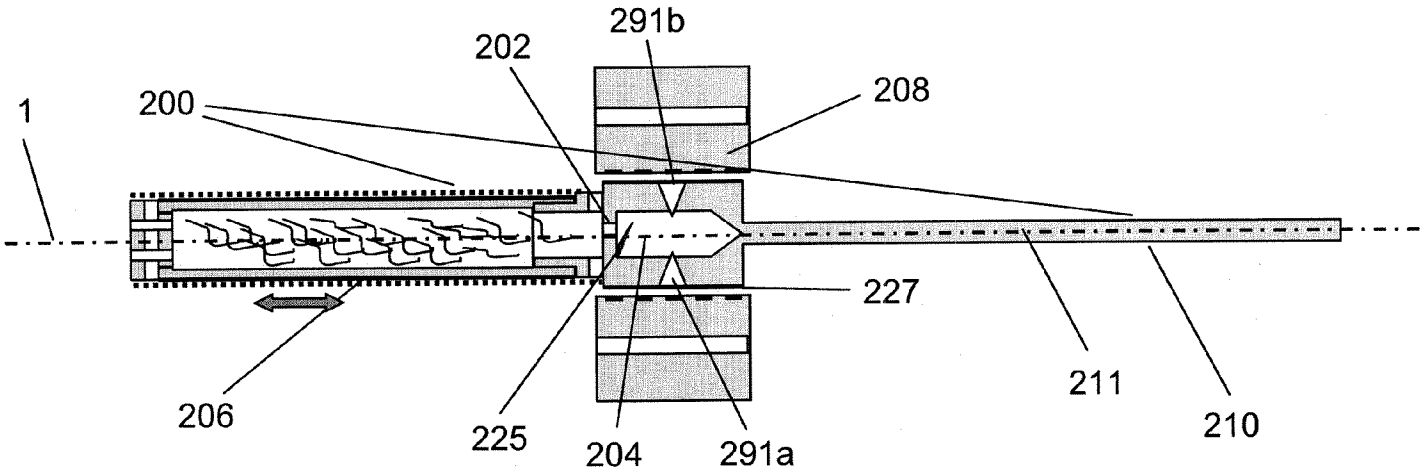
FIG. 10A is a cross-sectional view of the displacer illustrating the displacer gas bearing.

As shown in FIGS. 9 and 10A, the displacer 200 has a plurality of gas bearing ports 291*a-b* which can be used to direct gas into clearance gap 227 between the displacer 200 and the heat exchanger 208 to create a gas bearing for aligning the displacer body 206 and displacer rod 210 along the axis of the symmetry 1 of the cryocooler during assembly and for realizing a friction optimized gas bearing between the displacer rod 210 and the adjacent structures during normal cooler operation. The gas bearing ports 291*a-b* are located in the displacer rod 210, adjacent the heat exchanger 208. It should be understood that the illustrated embodiment comprises two additional gas ports 291*c-d* (not shown) symmetrically positioned relative to the illustrated gas bearing ports around the circumference of the displacer rod 210. In addition, in other embodiments, more or less gas bearing ports can be placed along the displacer. During normal operation of the cryocooler, compressed gas enters displacer cavity 204 via gas inlet 202 and exits gas bearing ports 291*a-b* and 291*c-d* (not shown), activating the gas bearing.

Figure 10B:
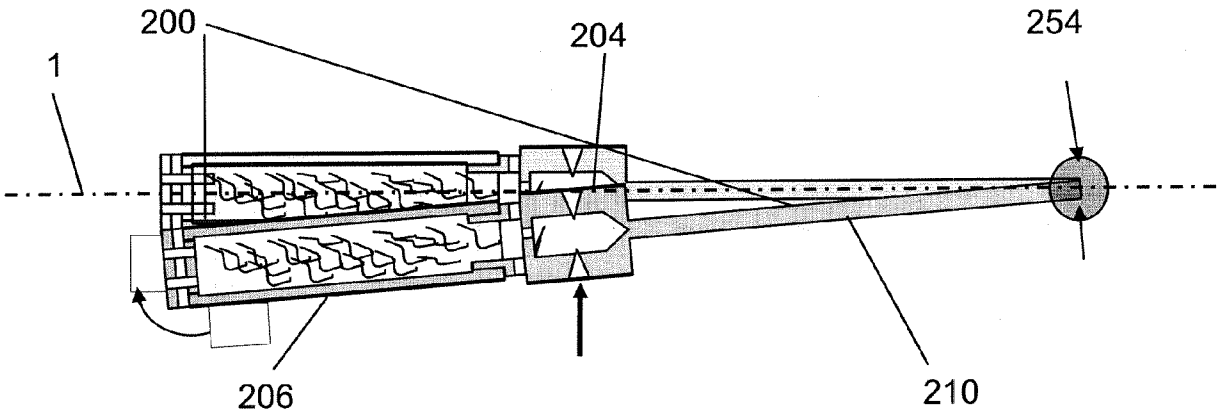
FIG. 10B is a cross-sectional view of the displacer illustrating the displacer rotating about its center of rotation when the gas bearing is activated.

As shown in FIG. 9, the spring 253 to be attached to the displacer rod 210 and the substantially laterally fixed structure 271 has a low axial, but high radial, stiffness such that when a center of rotation 254 is created on or near the axis of symmetry of 1 of the cryocooler and the displacer 200 (as shown in FIG. 10B) can only rotate about the center of rotation 254 and can no longer move laterally. As shown in FIG. 10B, during normal operation, activation of the gas bearing will cause the displacer 200 to rotate about the center of rotation 254 for achieving a proper alignment along the axis of symmetry 1 of the cryocooler. One end of the displacer rod 210 is supported by a rotational coupling having a center of rotation 254 along the axis of symmetry 1 of the cooler. During the activation of the gas bearing, gas is pumped through the gas bearing ports 291*a-b*. The gas bearing creates a rotational movement of the displacer 200 sufficient to align the displacer 200 and to realize a friction optimized bearing during normal cooler operation.

Figure 10C:
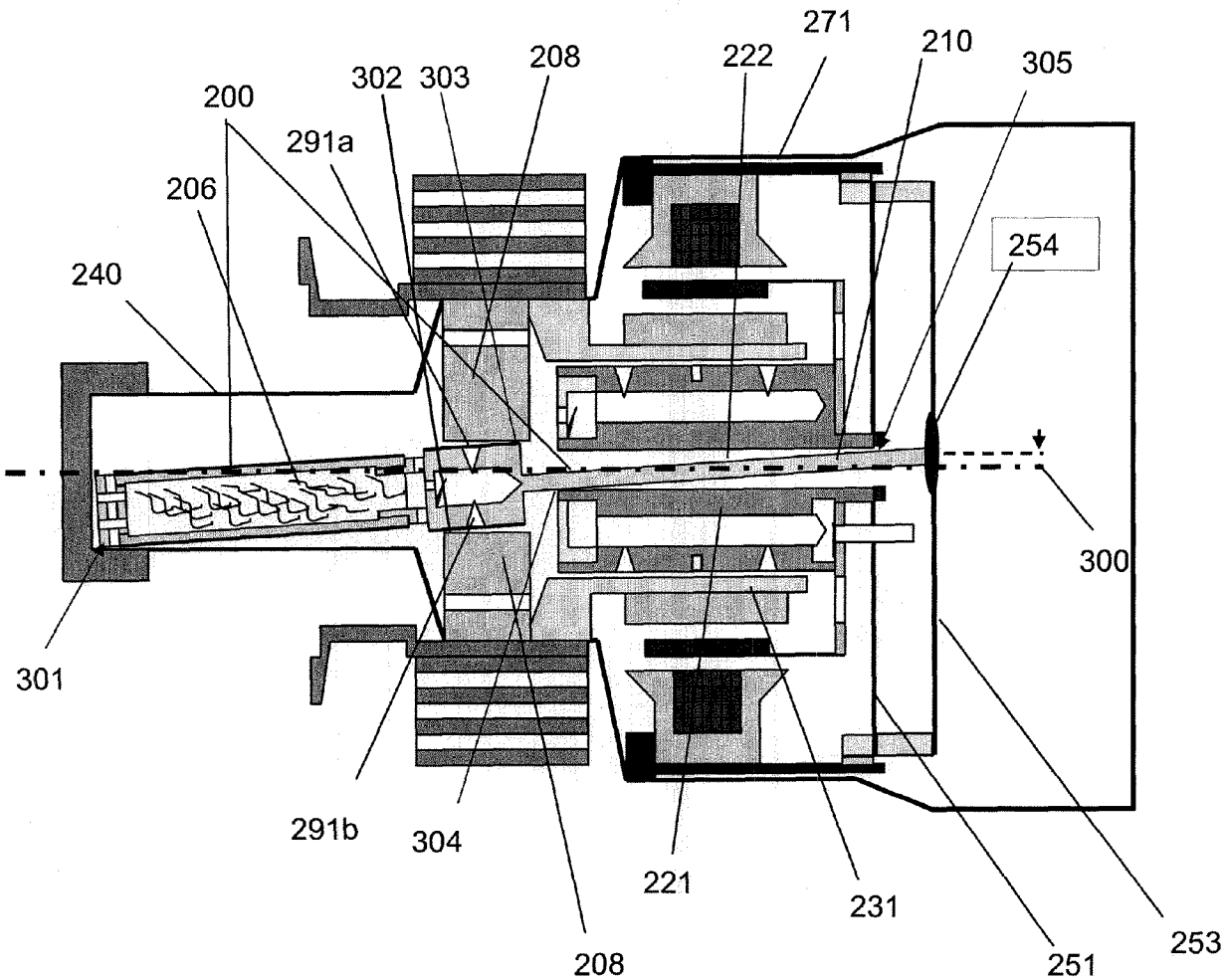
FIG. 10C is a cross sectional view of a displacer misaligned within the cooler assembly.

However, the displacer gas bearing can only work properly if the location of the center of rotation 254 of the displacer rod 210 is on or close to the cooler symmetry axis 1. As shown in FIG. 10C, an offset 300 between the displacer rod center of rotation 254 and the cooler symmetry axis 1 can cause the displacer 200 to tilt within the cooler assembly and touch the cooler assembly causing wear at several locations. For example, as shown, the displacer body 206 can touch the cold finger tube 240 at location 301, the displacer gas bearing can be partially deactivated as a free lateral movement of the displacer 200 is not possible at locations 302, 303 and the displacer rod 210 can rub against the inner bore 222 of the piston 221 at location 304 and 305. This means that the displacer body 206 and displacer rod 210 have to be properly pre-aligned during the assembly process for enabling proper functionality of the non-friction gas bearing. The alignment accuracy has to be realized within a few thousands, in some embodiments within a couple of ten-thousandths of an inch. This is difficult if not impossible to achieve "by hand."

Figure 11:
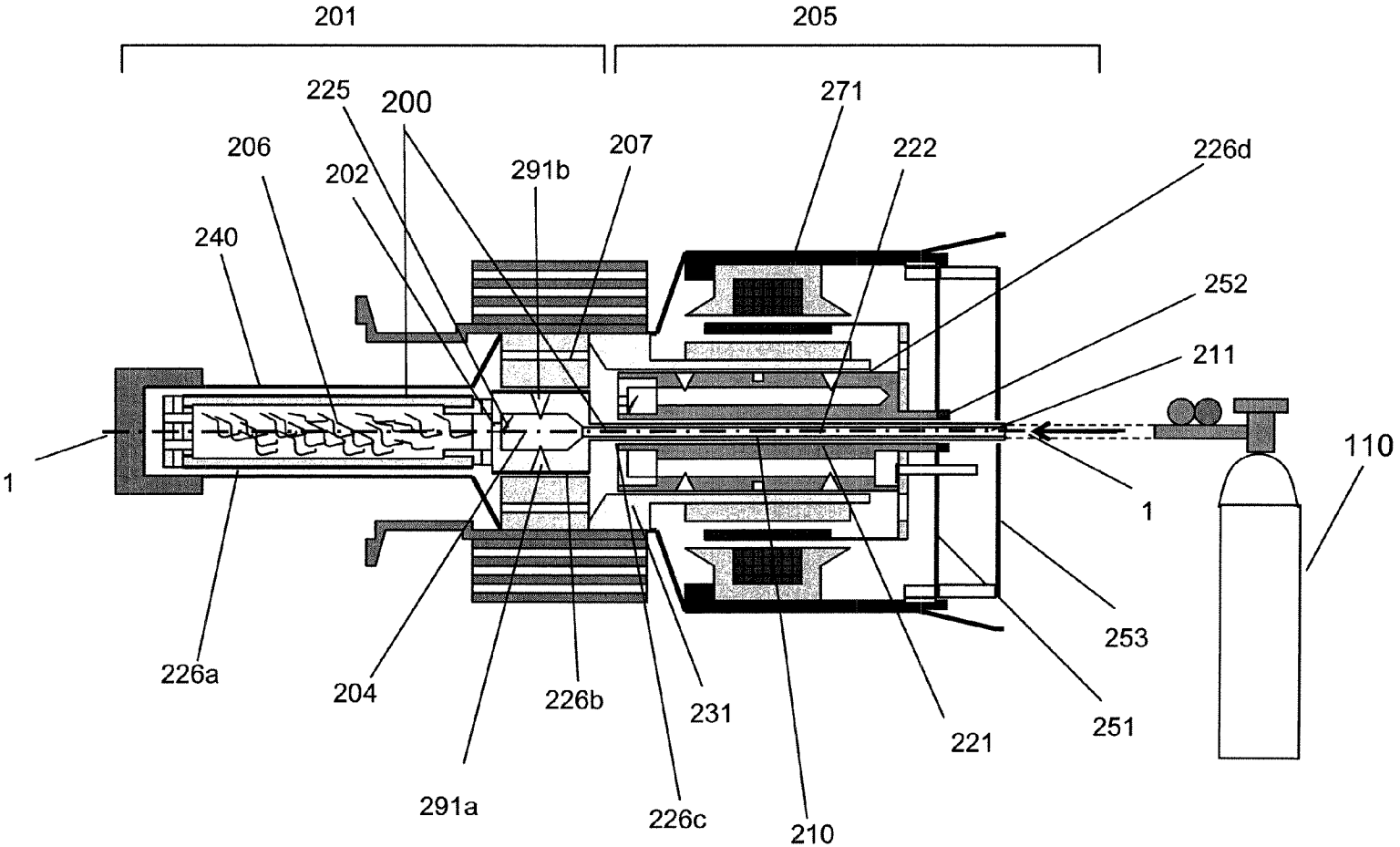
FIG. 11 illustrates a method of aligning the displacer during assembly by using an external gas source to activate the gas bearing.
Figure 12:
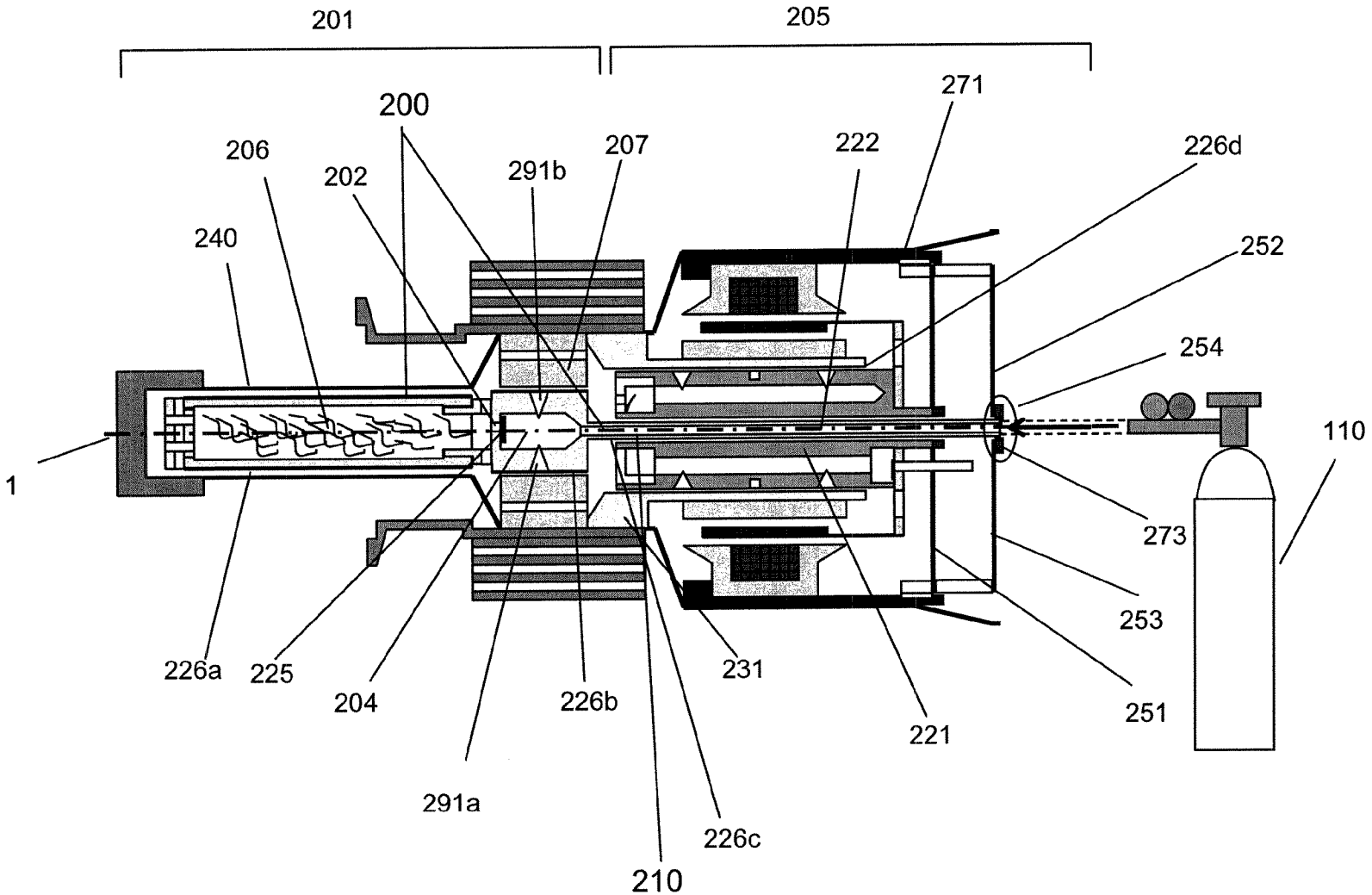
FIG. 12 illustrates a method of indirectly connecting the aligned displacer of FIG. 11 to the substantially laterally fixed structure.
Figure 13:
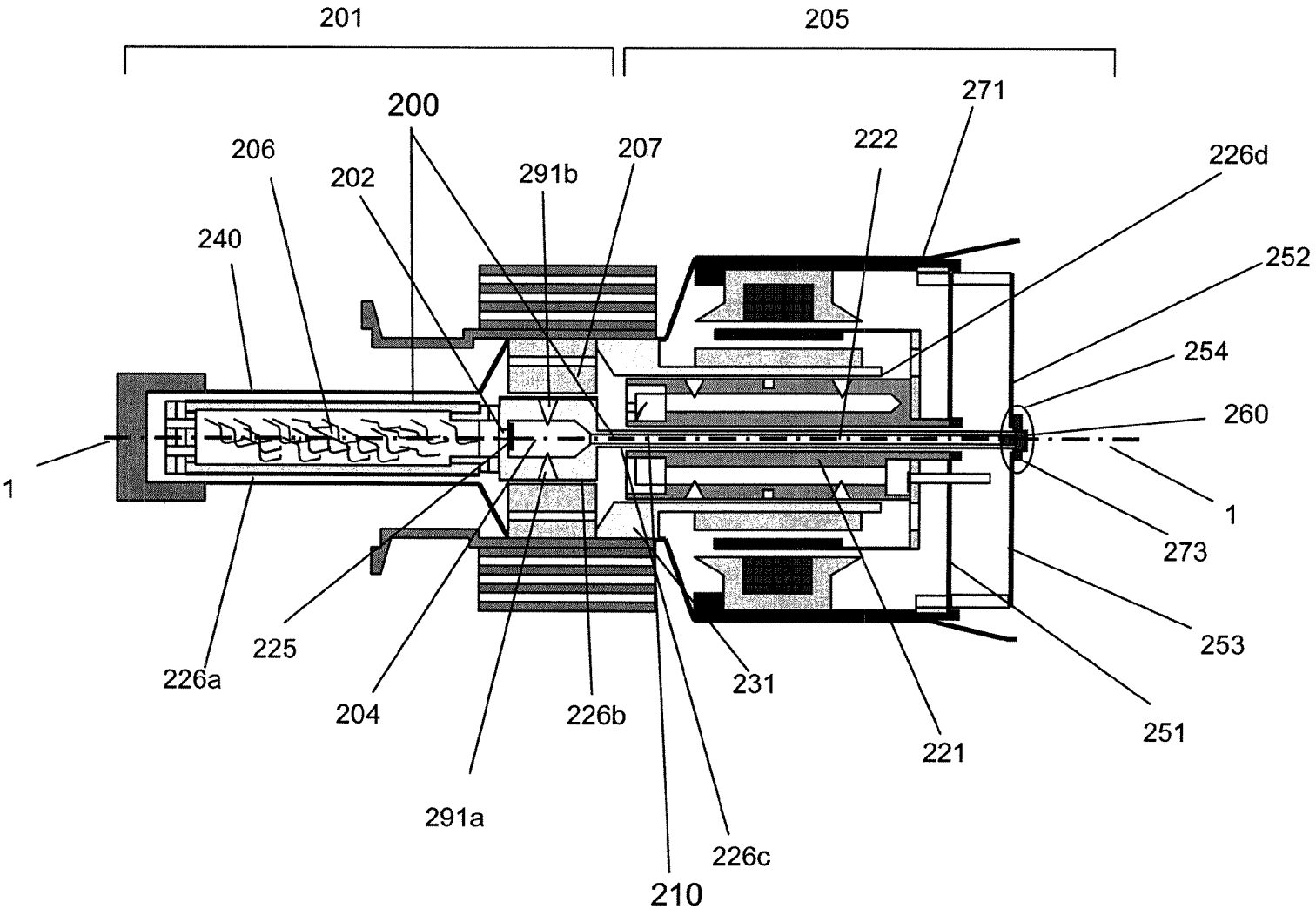
FIG. 13 illustrates a method for sealing the displacer cavity of FIG. 12 after the displacer has been connected to the substantially laterally fixed structure.

As shown in FIGS. 11-13, in one embodiment, the displacer body 206 and displacer rod 210 can be aligned automatically during the manufacturing and assembly process by activating the displacer gas bearing. Here, the displacer rod 210 contains a channel 211 in fluid communication with the displacer gas cavity 204. During assembly, an external gas source 110 is placed in fluid communication with the displacer rod channel 211 for transporting gas to the displacer cavity 204. The displacer gas cavity 204 has a check valve 225 on the gas inlet 202 which is closed by the pressure difference between the displacer cavity 204 and the surrounding volume to temporarily seal the gas inlet 202 during the assembly process, as shown in FIG. 12. When the pressurized gas flows into the displacer cavity 204, the gas will pass through gas bearing ports 291*a-b* into the clearance seal 226*b* activating the gas bearing. Thus, the displacer 200 is lifted and centered along the cooler axis of symmetry 1. As discussed above, during assembly, the gas bearing pressure is determined by the pressure of the external gas source 110 rather than the displacer cavity maximum volume or the maximum pressure inside the cooler during normal operation. Therefore, the higher than normal gas bearing forces allow for improved alignment and a more stable manufacturing process. In addition, while the cooler is shown horizontally for visualizing the lifting effect caused by the gas bearing, in some embodiments, a vertical orientation of the cooler during assembly can be used. The vertical orientation is more appropriate to reduce the side forces, i.e. gravity, to a minimum and further improve the alignment quality.

Moreover, while the gas bearing as described in this illustrated embodiment comprises a plurality of gas bearing ports 291*a-b* integrated into the displacer 200 with the gas bearing cavity 204 located in the displacer rod 210 and the gas bearing forces directed radially outward from the displacer rod 210 toward the heat exchanger 208, in some embodiments, as discussed above with respect to the compressor piston and the compressor bore, the gas bearing cavity could be located in the stationary component, such as the heat exchanger 208, adjacent to the displacer.

As shown in FIG. 12, once the displacer 200 has been substantially aligned along the cooler axis of symmetry 1, the end of the displacer rod 210 is connected to a displacer spring 253, thereby indirectly attaching the displacer to the substantially laterally fixed structure 271 and creating a center of rotation 254 about which the displacer 200 can rotate. Here, the displacer spring 253 is connected to a substantially laterally fixed structure 271, such as a spring cage, such that the displacer spring 253 acts as a flexure bearing or rotational coupling allowing the displacer rod 210 and displacer body 206 to rotate about the center of rotation 254, but preventing substantial lateral movement of the displacer body 206 and displacer rod 210 (see also FIG. 10B). In some embodiments, the displacer rod 210 is initially connected to the displacer spring 253 with a temporary connection such as glue (not shown), which does not require touching or manipulating the components and thus prevents external side forces during assembly which could radially deflect the displacer rod 210 and impact the alignment quality. Once the displacer rod 210 has been temporarily connected to the displacer spring 253, an additional mechanical connection 273, such as one or more screws, welding or brazing can be used to help to permanently fix the displacer rod 210 and the displacer spring 253.

Once the displacer rod 210 and piston spring 253 have been permanently connected, the external gas source 110 can be removed. The tip of the displacer rod 210 is now permanently fixed on or near the cooler axis of symmetry 1. The displacer spring 253 which is connected to spring cage 271 acts as a flexure bearing, allowing the displacer rod 210 and the displacer 200 to tilt, or pivot, and oscillate according to the cooler design intent. As shown in FIG. 13, the displacer rod channel 211 must be closed off so that the gas bearing can function properly during normal cooler operation. In some embodiments, the displacer rod channel 211 can be sealed permanently with a plug 260 at the tip of the displacer rod 210, or alternatively, in some embodiments a second check located in the displacer cavity 204 can be used to reversibly close off the displacer rod channel 211 (as described above with respect to the piston). The second check valve will automatically seal the opening between the displacer cavity 204 and displacer rod channel 211 during normal cooler operation due to the pressure difference between the displacer cavity 204 and the displacer rod channel 211.

Figure 14:
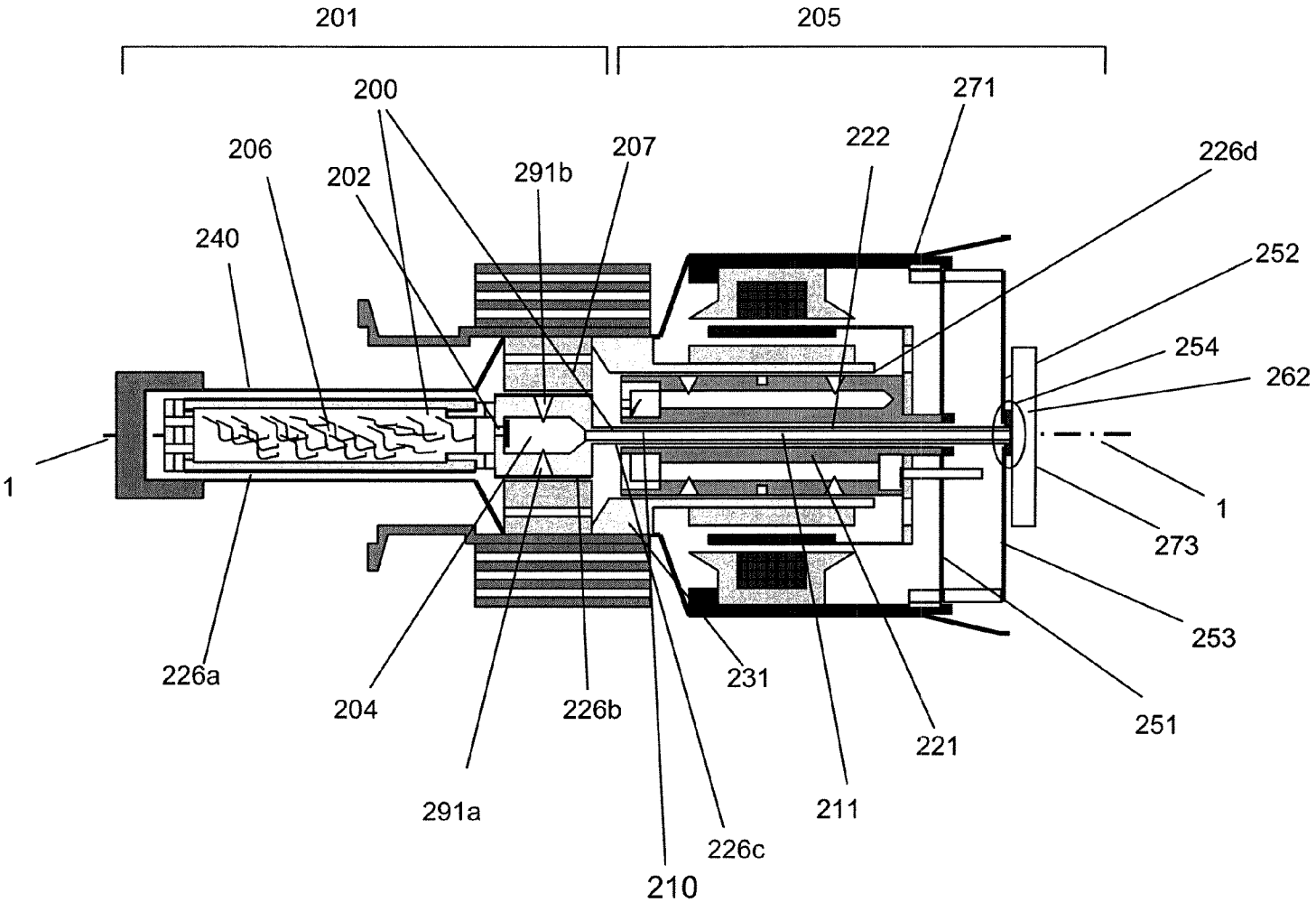
FIG. 14 illustrates an alternative method of sealing the displacer cavity using an additional external cavity volume.

In an alternative embodiment, as shown in FIG. 14, the displacer rod channel 211 can be closed with an additional volume cavity 262. The additional volume cavity 262 can provide an additional volume to supplement the volume of the displacer cavity 204 and provide a greater total volume for the gas bearing 290 during normal cooler operation. In some embodiments, the increased volume may be required to allow the gas bearing to operate at a sufficient pressure for aligning the displacer 200. In some embodiments, for example in smaller systems with a limited volume for the gas bearing, the additional volume cavity 262 can be used to increase the volume to the necessary level to provide sufficient gas bearing forces during normal cooler operation.

Figure 15:
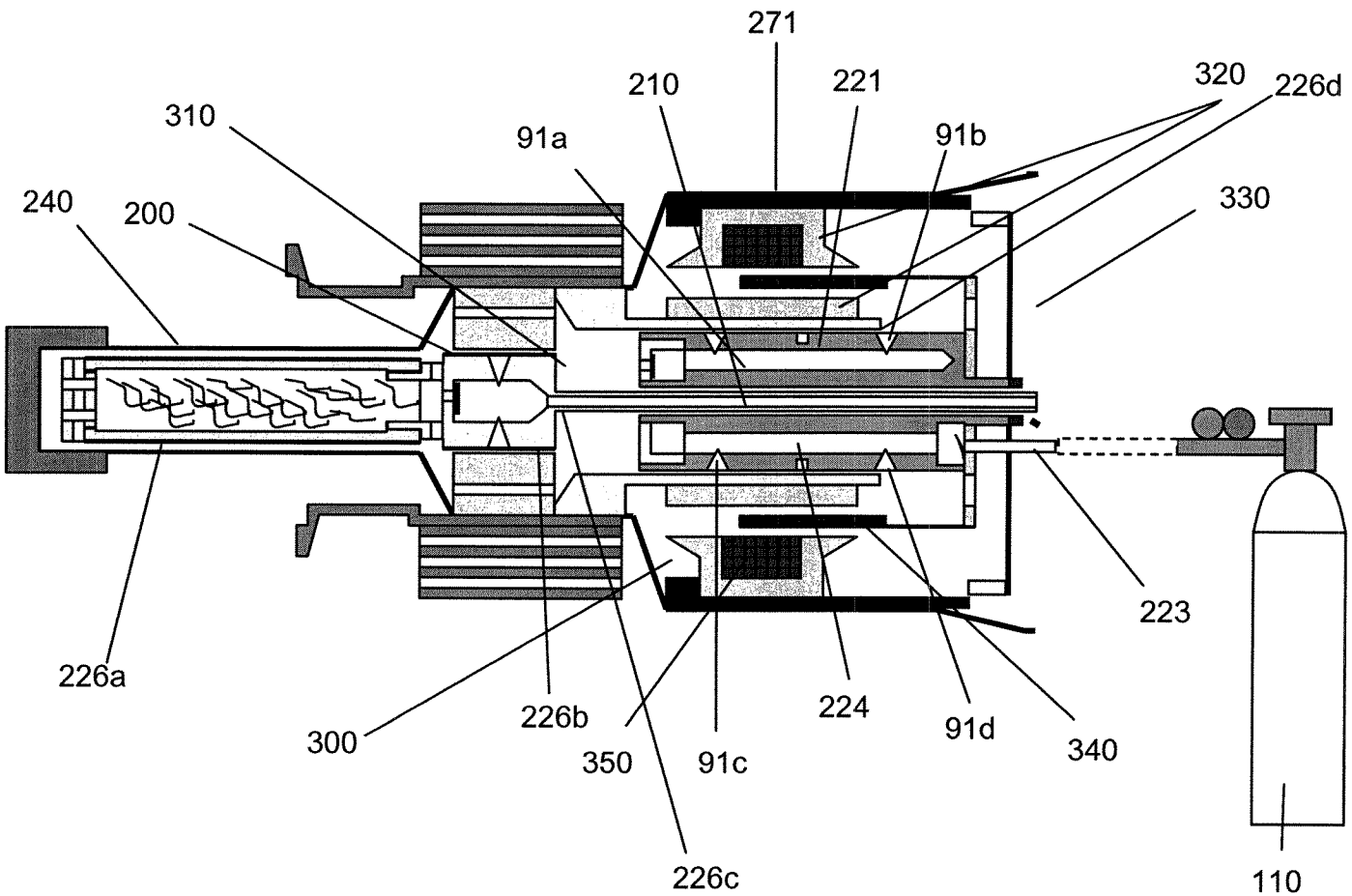
FIG. 15 illustrates the piston axially displaced during assembly due to the pressurized compression space caused by a unidirectional gas flow.
Figures 16A, 16B:
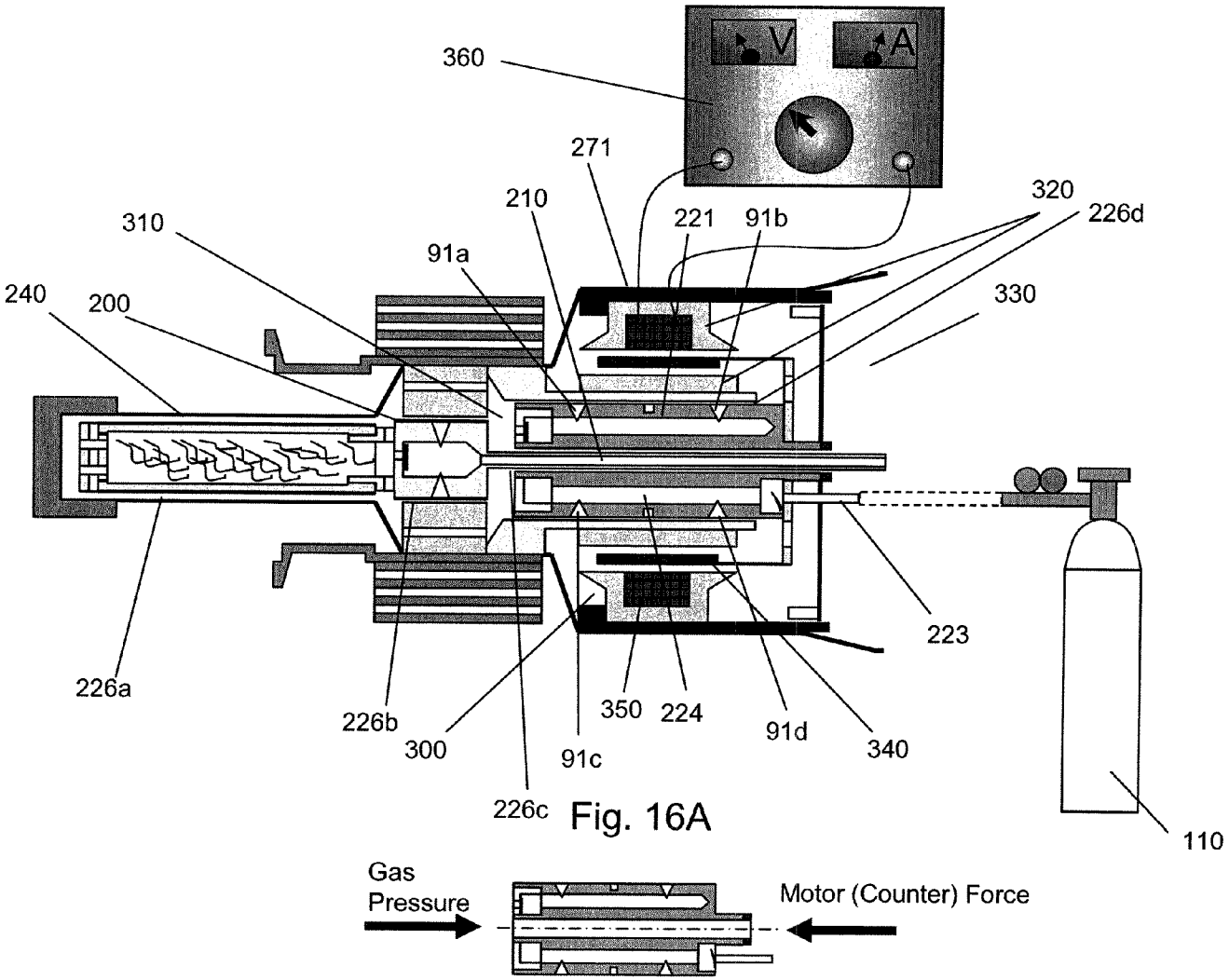
FIG. 16A illustrates a method of controlling the axial center position of the piston during assembly and alignment of the piston by activating the cooler motor.
FIG. 16B illustrates the forces of the motor countering the gas pressure forces to control and center the axial position of the piston.
Figure 17:
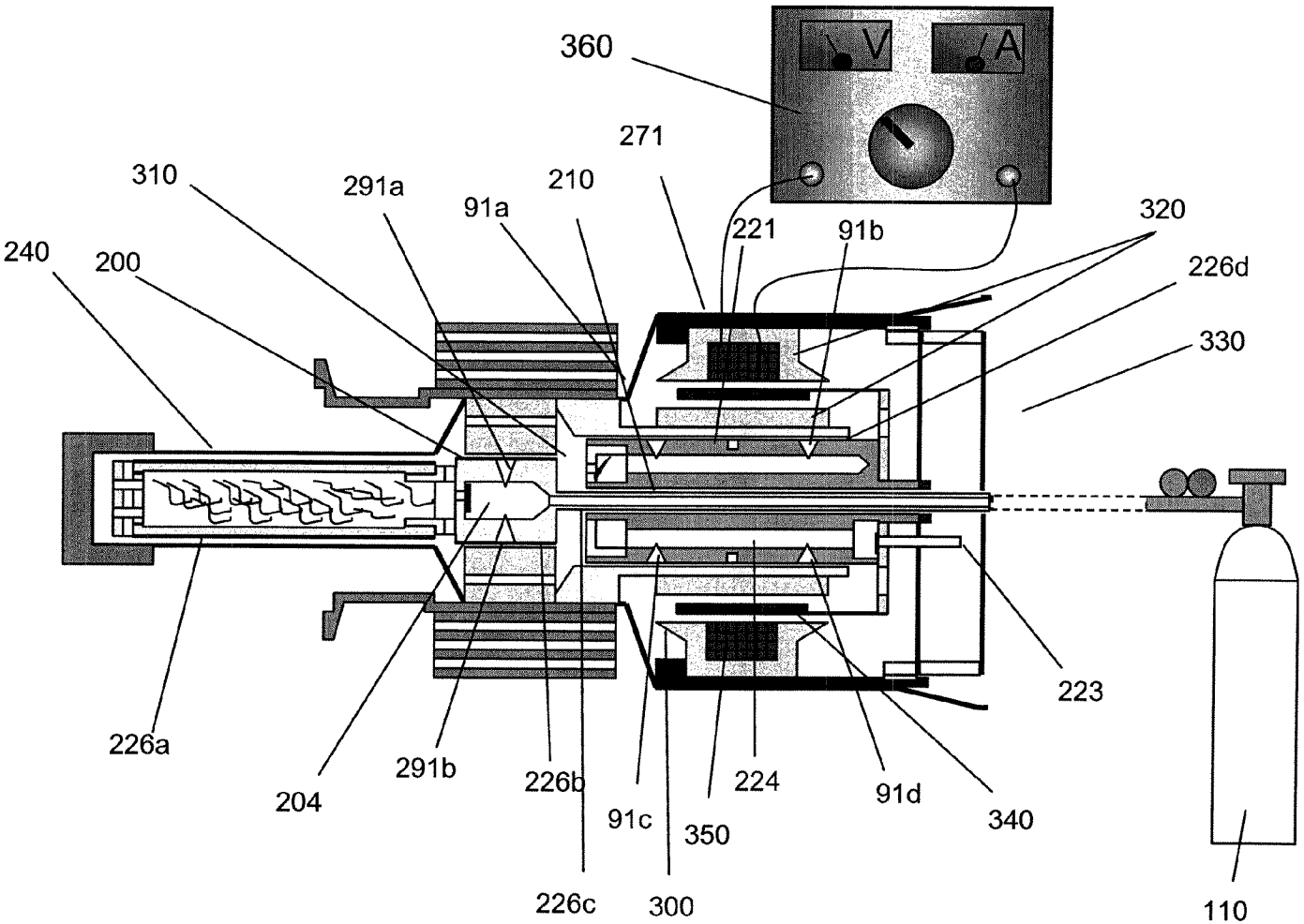
FIG. 17 illustrates a method of controlling the piston center position during assembly of the displacer by activating the cooler motor.

In some embodiments, as shown in FIGS. 15-17, an additional step may be necessary to control the axial piston center position during the alignment and assembly process of either or both the piston 221 and the displacer 200. For example, as shown in FIG. 15, the activation of the gas bearing during the assembly process can generate unwanted pressure differences inside a system, which might have a negative impact on the alignment and assembly quality. This basic problem applies to the activation of the piston and the displacer gas bearing during the assembly of the Stirling cooler shown in FIG. 13.

The problem is shown in FIG. 15 which illustrates the axially displaced piston caused by a pressure difference while the gas bearing is active. The constant, unidirectional gas flow from the gas source 110 to the piston cavity 224 causes a gas pressure increase inside the compression space 310. The piston 221 and the displacer rod 210 are equipped with clearance seals 226*b-d* so that a certain pressure difference is required for releasing the gas flow through these seals towards the backspace 330. The pressure difference causes an axial displacement of the piston 221, a situation that in most cases is unacceptable for assembling the cooler properly. A counterforce is therefore required to keep the piston 221 axially centered.

One option is to use weights (gravity) to provide the counterforce and neutralize the pressure difference while aligning the components in a vertical orientation. The challenge is however to radially align the center of gravity of the weight with the symmetry axis of the piston. Otherwise, the piston might be tilted and the alignment process compromised.

FIGS. 16A-B shows an alternative and improved method for activating the required counterforce. Here, the cooler motor 300 is activated during the assembly and alignment process to provide a counterforce keeping the piston 221 axially centered. The motor 300 is comprised by inner and outer laminations, for example U-shaped laminations 320, a motor coil 350 and moving magnets 340. The motor 300 is designed and optimized for generating a nearly perfect axial force thus preventing piston side-loads during operation. A constant motor force can be generated by powering the coil 350 with a dc current provided by the power supply 360 during assembly. The direction of the current determines the orientation of the force. As shown in FIG. 16B, the electrical current can be adjusted or automatically regulated to counter the gas pressure force for achieving the required axial position of the piston and maintaining it during the last bonding operations for completing the assembly of the cooler. FIG. 17 shows a similar situation while the displacer 200 is aligned and assembled. Gas is flowing from the gas source 110 to the displacer cavity 204 through the gas bearing ports 291*a-b* and pressurizing the cooler working space and especially the compression space 310 of the cooler. As described above, the piston 221 and the displacer rod 210 are equipped with clearance seals 226*b-d* so that a certain pressure difference is required for releasing the gas flow through these seals towards the backspace 330. The pressure difference which could cause an axial displacement of the piston 221 is countered by activating the motor 300 using a DC current provided by power supply 360. The above describe method can also be used for Stirling coolers or engines, which are equipped with moving coil or other types of linear motors.

Although the foregoing invention has been described in some detail by way of illustration and example for purposes of clarity and understanding, it will be readily apparent to those of ordinary skill in the art, in light of the teachings of this invention, that certain changes and modifications may be made thereto without departing from the spirit or scope of the appended claims.

For example, the methods of this invention may also be used in structures having reciprocating or rotating bodies, but which do not utilize gas bearings during their normal operation. The methods and apparatus may be used in such structures where a gas bearing is utilized as described above, for the alignment or centering operations. The gas bearing may then be disabled or otherwise removed in normal operation as it is not required.

In other embodiments, the described alignment method can be used for coolers equipped with a compliant or a non-compliant structure for supporting the piston, the displacer and motor components.

I claim:

1. A method for assembling a reciprocating body within a chamber, where the body couples through a rotational coupling to a substantially laterally fixed structure to the chamber, the reciprocating body including a first gas inlet, a gas bearing cavity and one or more gas bearing ports disposed toward the chamber, the first gas inlet, gas bearing cavity and gas bearing ports being in fluidic communication, comprising the steps of:

providing a reciprocating body within the chamber, flowing gas through the first gas inlet to the gas bearing cavity and through the gas bearing ports toward sidewalls of the chamber (1) while the body is not coupled to a substantially laterally fixed structure (2) at a pressure at least sufficient to cause the reciprocating body to position into a non-contact relationship with the sidewalls of the chamber within the chamber, affixing the rotational coupling to the substantially laterally fixed structure, said affixing comprising:

temporarily attaching the rotational coupling to the structure, and permanently attaching the rotational coupling to the structure, and discontinuing the gas flow.

2. The method for assembling a reciprocating body within a chamber of claim 1 wherein the pressure used during the assembly is greater than the pressure used during operation of the device after assembly.

3. The method for assembling a reciprocating body within a chamber of claim 1 wherein permanently attaching the rotational coupling comprises using a method selected from the group consisting of: using one or more screws, welding the rotational coupling to the structure, or brazing of the rotational coupling to the structure.

4. The method for assembling a reciprocating body within a chamber of claim 1 comprising closing the first gas inlet after assembly.

5. The method for assembling a reciprocating body within a chamber of claim 1 wherein the reciprocating body has a second gas inlet in fluid communication with the gas bearing cavity and the one or more gas bearing ports, the second inlet configured for use during operation of the reciprocating body, the second gas inlet having a check valve for selectively sealing the second gas inlet during assembly of the reciprocating body within the chamber.

6. The method for assembling a reciprocating body within a chamber of claim 1 wherein the gas bearing cavity has one or more check valves for selectively activating at least one of the one or more gas bearing ports.

7. The method for assembling a reciprocating body within a chamber of claim 1 wherein the reciprocating body and chamber are disposed vertically during assembly.

8. The method for assembling a reciprocating body within a chamber of claim 1 wherein the reciprocating body and chamber are disposed horizontally during assembly.

9. The method for assembling a reciprocating body within a chamber of claim 1 wherein the reciprocating body is a piston.

10. The method for assembling a reciprocating body within a chamber of claim 1 wherein the reciprocating body is a displacer.

11. The method for assembling a reciprocating body within a chamber of claim 1 wherein the device is a Stirling cycle cooler.

12. The method for assembling a reciprocating body within a chamber of claim 1 wherein the device is a motor.

13. The method of claim 1, further comprising applying a counterforce sufficient to neutralize the pressure build up in a compression space between the reciprocating body and the chamber due to the gas flowing through the gas bearing ports.

14. The method of claim 13, wherein the counterforce is sufficient to axially center the reciprocating body.

15. The method of claim 14 wherein the counterforce is generated by a motor by powering a coil of the motor with a dc current.

16. The method of claim 15, further comprising adjusting the current to control the axial position of the reciprocating body.

17. A method for assembling a reciprocating body within a chamber, where the body couples through a rotational coupling to a substantially laterally fixed structure to the chamber, the chamber body including a first gas inlet, a gas bearing cavity and one or more gas bearing ports disposed toward the reciprocating body, the first gas inlet, gas bearing cavity and gas bearing ports being in fluidic communication, comprising the steps of:

providing a reciprocating body within the chamber, flowing gas through the first gas inlet to the gas bearing cavity and through the gas bearing ports toward the reciprocating body (1) while the body is not coupled to a substantially laterally fixed structure (2) at a pressure at least sufficient to cause the reciprocating body to position into a non-contact relationship with the sidewalls of the chamber within the chamber, temporarily affixing the rotational coupling to the substantially laterally fixed structure, discontinuing the gas flow, and permanently affixing the rotational coupling to the substantially laterally fixed structure.

18. The method for assembling a reciprocating body within a chamber of claim 1 wherein the gas flow is discontinued after the step of temporarily attaching the rotational coupling to the structure, but before the step of permanently attaching the rotational coupling to the structure.

* * * * *